US006508212B2

(12) United States Patent
Song et al.

(10) Patent No.: US 6,508,212 B2
(45) Date of Patent: Jan. 21, 2003

(54) CARTRIDGE THERMOSTAT SYSTEM

(75) Inventors: Ho Chul Song, Melrose Park, IL (US); Bruce B. Dombek, Melrose Park, IL (US); Steve R. Ostarello, Melrose Park, IL (US)

(73) Assignee: International Engine Intellectual Property Company, L.L.C., Warrenville, IL (US)

( * ) Notice: Subject to any disclaimer, the term of this patent is extended or adjusted under 35 U.S.C. 154(b) by 0 days.

(21) Appl. No.: 10/116,496

(22) Filed: Apr. 4, 2002

(65) Prior Publication Data

US 2002/0166516 A1 Nov. 14, 2002

Related U.S. Application Data

(62) Division of application No. 09/851,044, filed on May 8, 2001.

(60) Provisional application No. 60/197,918, filed on Apr. 17, 2000.

(51) Int. Cl.[7] ..... F01P 7/14

(52) U.S. Cl. ..... 123/41.1; 236/34.5

(58) Field of Search ..... 123/41.1, 41.08, 123/41.09; 236/34.5

(56) References Cited

U.S. PATENT DOCUMENTS

| | | | | |
|---|---|---|---|---|
| 3,510,060 A | * | 5/1970 | Starmuhler | 236/34.5 |
| 4,938,185 A | * | 7/1990 | Doke | 123/195 C |
| 4,982,704 A | * | 1/1991 | Sliger | 123/41.1 |
| 5,715,776 A | * | 2/1998 | Seidl | 123/198 C |
| 5,970,928 A | * | 10/1999 | Smietanski et al. | 123/41.54 |

* cited by examiner

*Primary Examiner*—Gene Mancene
*Assistant Examiner*—Hyder Ali
(74) *Attorney, Agent, or Firm*—Dennis Kelly Sullivan; Jeffrey P. Calfa; Neil T. Powell

(57) ABSTRACT

The present invention provides a cartridge thermostat system that permits removal and replacement of the thermostat without removing the housing or coolant manifold. In the cartridge thermostat system, a coolant manifold is mounted on a cylinder head of an engine. The cylinder head has an engine by-pass and a coolant port for receiving a pilot on the coolant manifold. The coolant manifold further comprises at least one thermostat port with an associated cartridge thermostat and at least one passage for appropriate coolant flow. The cartridge thermostat fastens to the thermostat port and operatively positions a plug to an engine by-pass and a sleeve to a coolant passage. A wax plug in the cartridge thermostat expands when the coolant is hot and thereby appropriately and simultaneously positions the plug relative to the engine by-pass and the sleeve relative to the coolant passage.

35 Claims, 18 Drawing Sheets

CARTRIDGE THERMOSTAT SYSTEM

This is a division of application Ser. No. 09/851,044, filed May 8, 2001, which claims the benefit of provisional patent application Ser. No. 60/197,918, filed Apr. 17, 2000.

FIELD OF THE INVENTION

This invention relates generally to thermostats for engine cooling systems. More particularly, this invention relates to cartridge thermostats with a housing that forms part of the cooling system for an internal combustion engine.

BACKGROUND OF THE INVENTION

Internal combustion engines have cooling systems to prevent the engine from overheating. FIG. 1 shows a typical cooling system from the prior art. As illustrated, a water pump in the front cover pumps coolant through passageways surrounding the cylinder sleeves in the engine. The coolant flows through the cylinder head before entering a by-pass passage for return to the water pump. At the cylinder sleeves, a portion of the coolant is diverted to pass through the oil cooler before returning to the water pump.

A thermostat is positioned in the coolant passageway at the entrance of the by-pass in the cylinder head. The thermostat opens and closes depending upon the coolant temperature. When the coolant temperature rises above a particular temperature, the thermostat closes the by-pass passage and opens the radiator passage to divert coolant to the radiator. The coolant passes through the radiator before returning to the water pump.

In many internal combustion engines, the thermostat is positioned inside a thermostat housing. FIG. 2 shows this arrangement according to the prior art. A hose connects the thermostat housing to the radiator. The housing separates the radiator hose from the engine, thus making it easier to remove the radiator hose. While maintenance of the radiator and hoses is easier, the thermostat housing does not reduce the difficulties of replacing a thermostat.

To replace the thermostat, the housing must be removed. While it is routine to remove the bolts securing the housing to the engine, it is rather difficult to get to the housing. In many engines, the housing is located beneath or is obstructed by auxiliary equipment and other engine parts. These equipment and parts must be removed before there is sufficient access to remove the thermostat housing.

Moving the auxiliary equipment and engine parts increases the time and cost of replacing the thermostat. It also is a deterrent to replacing the thermostat as part of routine or preventative maintenance of the engine. This leads to overheating and breakdowns of the engine while it is in service.

Accordingly, there is a need for a thermostat which may be replaced with out removing the thermostat housing.

SUMMARY OF THE INVENTION

The present invention provides a cartridge thermostat system that permits removal and replacement of the thermostat without removing the housing or coolant manifold. In the cartridge thermostat system, a coolant manifold is mounted on a cylinder head of an engine. The cylinder head has an engine by-pass and a coolant port for receiving a pilot on the coolant manifold.

In a first embodiment, the coolant manifold has a thermostat port and a radiator passage. A cartridge thermostat screws into the thermostat port and operatively positions a plug adjacent to the engine by-pass. A wax plug in the cartridge thermostat expands when the coolant is hot to move the plug against the engine by-pass.

In a second embodiment, the cartridge thermostat operatively positions a plug adjacent to an engine by-pass and operatively positions a sleeve adjacent to a radiator passage. The plug and sleeve are connected to move together along a shaft on the cartridge thermostat. A wax plug expands when the coolant temperature increases, thus moving the plug and sleeve.

When the engine is cold the sleeve blocks the radiator passage. The engine by-pass is open permitting coolant to flow through the engine by-pass. When the engine is hot the wax plug moves the plug to close the engine by-pass. Coolant stops flowing through the engine by-pass. At the same time, the wax plug also moves the sleeve to open the radiator passage. Coolant flows through sleeve holes in the sleeve and through the radiator passage to the radiator.

In a third embodiment, the coolant manifold has a manifold by-pass and a radiator passage. The wax plug moves the sleeve to open and close the manifold by-pass and the radiator passage as the coolant temperature increases and decrease. The plug seals the engine. by-pass.

In a fourth embodiment, the coolant manifold has two thermostat ports. This enables the same coolant manifold to be used on two engine configurations. The thermostat ports are connected by a coolant passage. The second thermostat port is connected independently to a manifold by-pass and a radiator passage.

In the first engine configuration, a cartridge plug extends through the first thermostat port. The cartridge plug seals the engine by-pass preventing coolant from flowing into the engine by-pass. A cartridge thermostat extends through the second thermostat port. The cartridge thermostat operatively positions a sleeve adjacent to the manifold by-pass and the radiator passage.

When the engine is cold, the sleeve blocks the radiator passage preventing coolant from circulating through the radiator. Coolant passes through the first thermostat port, through the coolant passage, through the second thermostat port, through sleeve holes in the sleeve, and through the manifold by-pass.

When the engine is hot, a wax plug in the cartridge thermostat expands and moves the sleeve to open the radiator passage and to block the manifold by-pass. Coolant passes through the first thermostat port, through the coolant passage, through the second thermostat port, and through the radiator passage to the radiator.

In the second engine configuration, a cartridge thermostat extends through the first thermostat port. The cartridge thermostat operatively positions a sleeve adjacent to the coolant passage. The cartridge thermostat also operatively positions the plug adjacent to the engine by-pass. The cartridge thermostat has a wax plug which expands when the coolant is hot. The wax plug moves the sleeve and plug together. A cartridge cap extends into the second thermostat port The cartridge cap seals the second thermostat port. A manifold plug blocks the flow of coolant out of the manifold by-pass.

When the engine is cold, the sleeve blocks the coolant passage preventing coolant from circulating through the radiator. The plug is open permitting coolant to flow through the engine by-pass.

When the engine is hot, a wax plug in the cartridge thermostat expands and moves the sleeve to open the coolant passage. At the same time, the wax plug moves the plug to seal the engine by-pass. Coolant passes through the first thermostat port, through sleeve holes, through the coolant passage, through the second thermostat port, and through the radiator passage to the radiator.

As described, a wax plug is used to move the sleeve and/or plug in these embodiments. However, an electric or other operating means for a thermostat may be used to increase the stroke length of the thermostat. In addition, the diaphragm in the thermostat may be altered to also increase the stroke length. An optional air bleed system may be incorporated into the cap of the cartridge thermostat.

The following drawings and description set forth additional advantages and benefits of the invention. More advantages and benefits are obvious from the description and may be learned by practice of the invention.

BRIEF DESCRIPTION OF THE DRAWINGS

The present invention may be better understood when read in connection with the accompanying drawings, of which.

DESCRIPTION OF THE INVENTION

Figure 1:
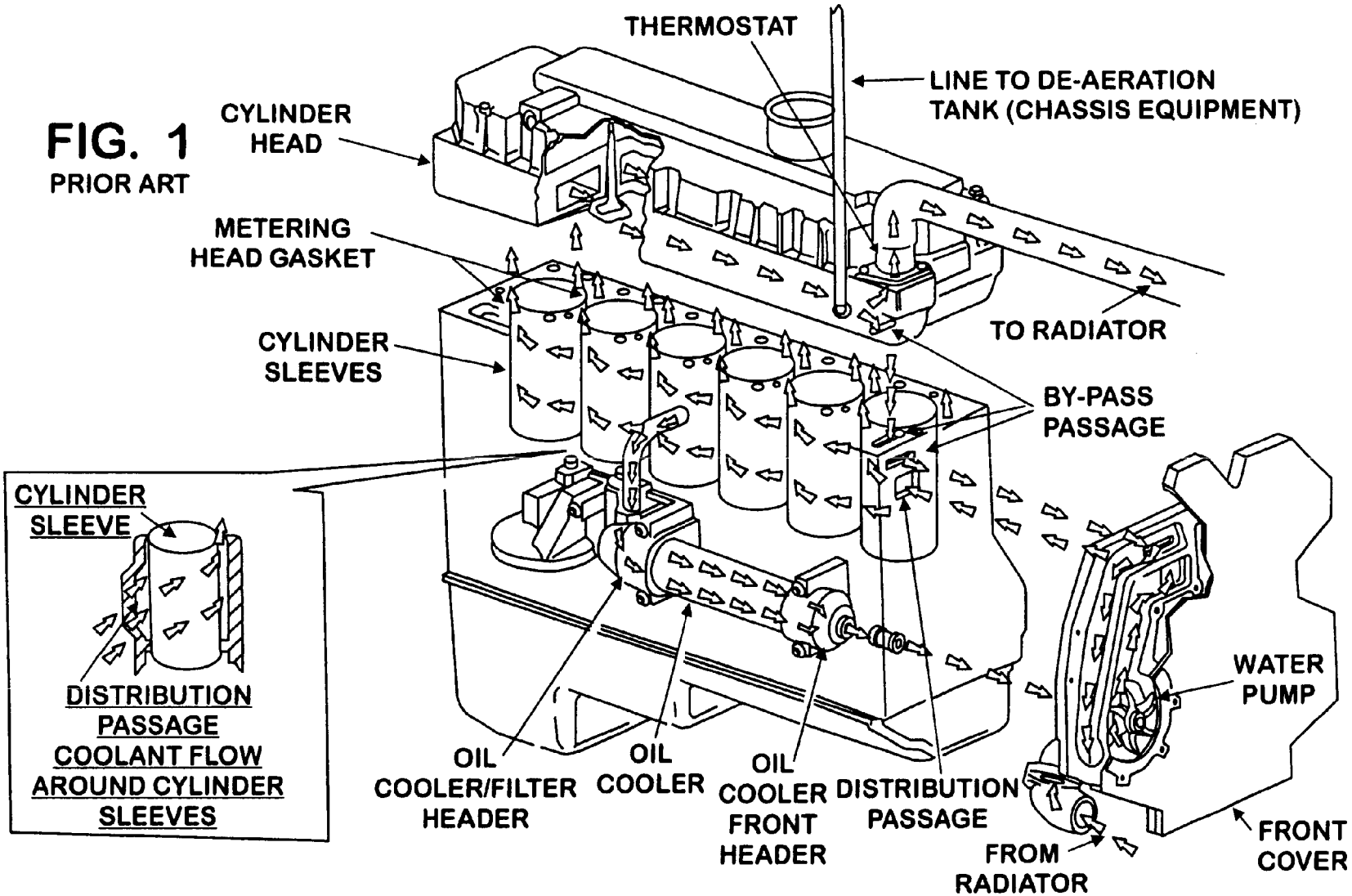
FIG. 1 PRIOR ART
FIG. 1 shows a perspective view of a cooling system for an internal combustion engine according to the prior art.
Figure 2:
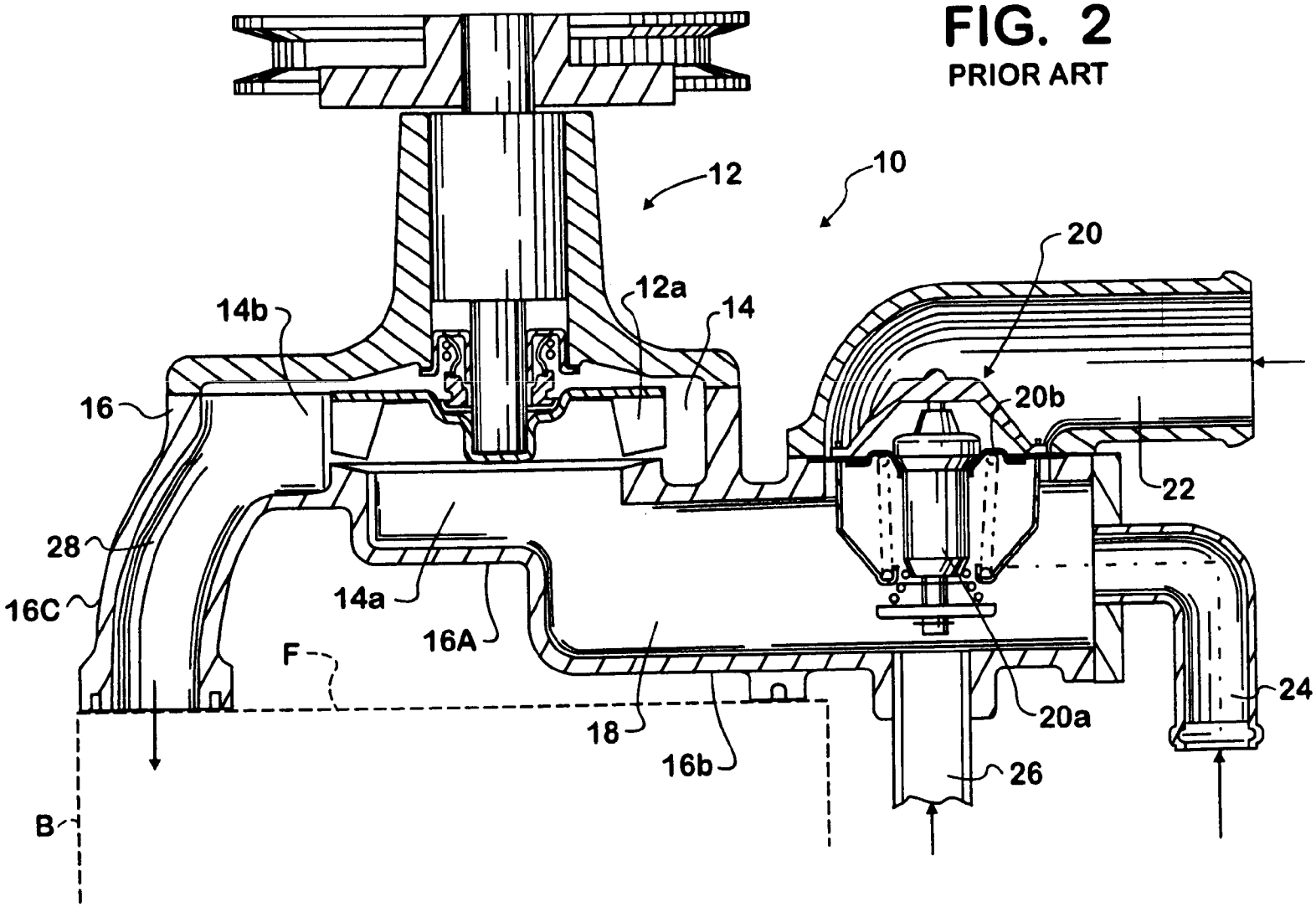
FIG. 2 PRIOR ART
FIG. 2 shows a cross-sectional side view of a cooling manifold with a thermostat according to the prior art.
Figure 3:
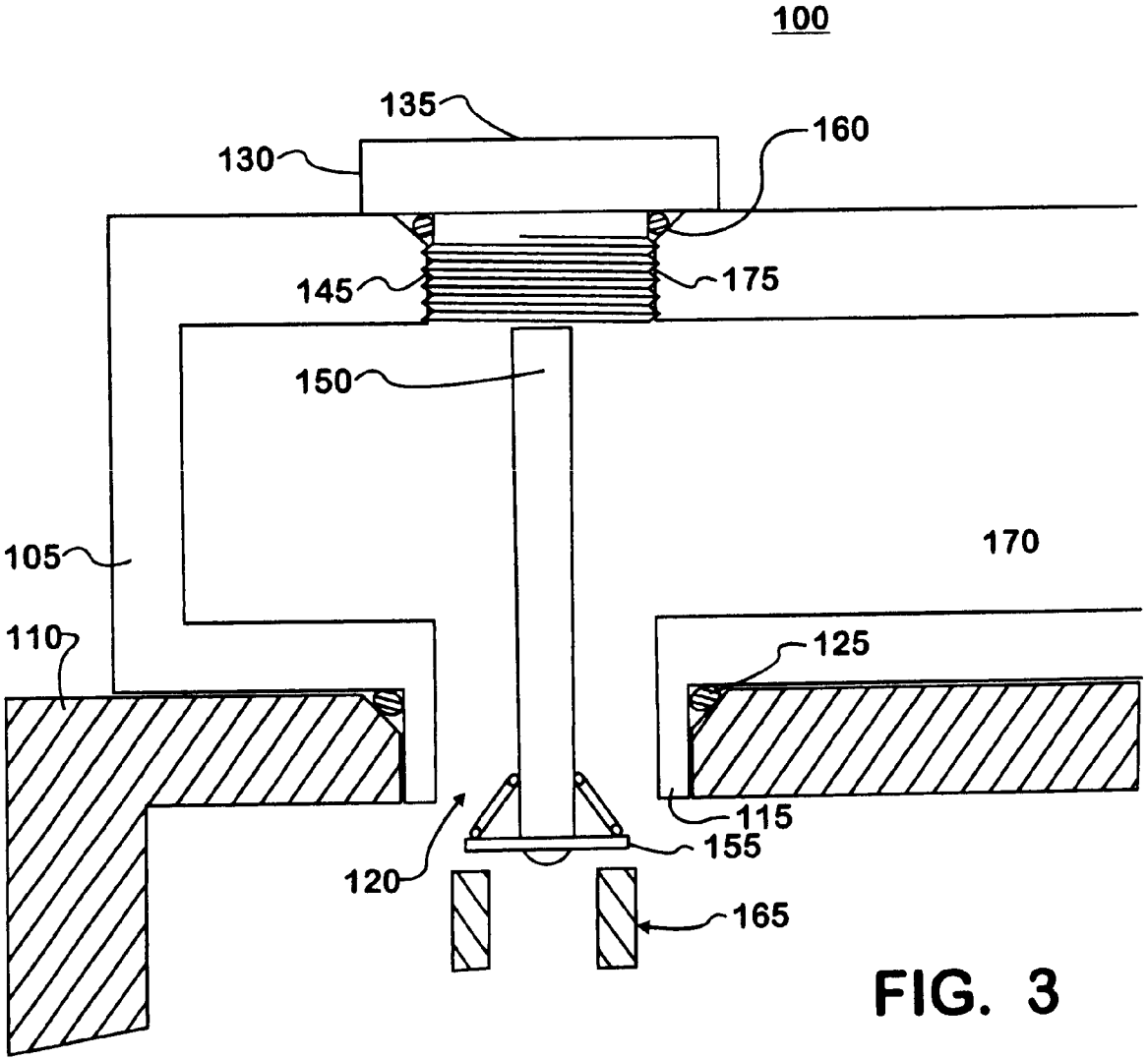
FIG. 3 shows a cross-sectional side view of a cartridge thermostat system according to the first embodiment of the present invention.

FIG. 3 shows a first embodiment of a cartridge thermostat system 100 according to the present invention. A coolant manifold 105 is mounted on a cylinder head 110 of an engine (not shown). The coolant manifold 105 forms a radiator passageway 170 for circulating coolant to the radiator (not shown). The cylinder head 110 has an engine by-pass 165 for circulating coolant to the engine. The coolant manifold 105 also has a pilot 115, which inserts into a coolant port 120 formed by the cylinder head 110. A manifold o-ring 125 extends around the pilot 115 at its interface with the coolant port 120 for sealing the connection of the coolant manifold 105 with the cylinder head 110.

A cartridge thermostat 130 extends through a thermostat port 175 formed by the coolant manifold 105. The cartridge thermostat 130 has a cap 135, a threaded portion 145, a shaft 150, and a plug 155. A wax plug is hidden from view inside the cartridge thermostat 130. The wax plug expands and contracts upon heating and cooling to actuate the shaft 150.

The threaded portion 145 is configured for engaging a similarly threaded portion of the coolant manifold 105 along the thermostat port 175. A thermostat o-ring 160 surrounds the cartridge 140 adjacent to the connection of the threaded portion to the cap 135.

To install the cartridge thermostat 130, it is inserted into the coolant manifold 105 and screwed into place. The thermostat o-ring 160 engages the coolant manifold 105 thus sealing the thermostat port 175. The shaft 150 extends through the coolant manifold 105 and the pilot 115, placing the plug 155 in an operating position adjacent to the engine by-pass 165. The plug 155 and shaft 150 may include a spring (not shown) or other elastomeric device to compensate for their expansion when the coolant is hot. To remove the cartridge thermostat 130, it is simply unscrewed from the coolant manifold 105.

When the engine is cold, the plug 155 is inside the pilot 115, thus blocking the flow of coolant to the radiator passage 170. The engine by-pass 165 is open, permitting coolant to circulate through the engine.

As the engine temperature increases, the coolant temperature also rises. The wax plug expands inside the cartridge thermostat 130. At a certain temperature or predetermined value, usually 190° F., the wax plug actuates the shaft 150 to move the plug 155 against the engine by-pass 165. In this position, the plug 155 stops the flow of coolant through the engine by-pass 165. The coolant flows through the pilot 115, into the radiator passage 170, and then into the radiator.

Figure 4:
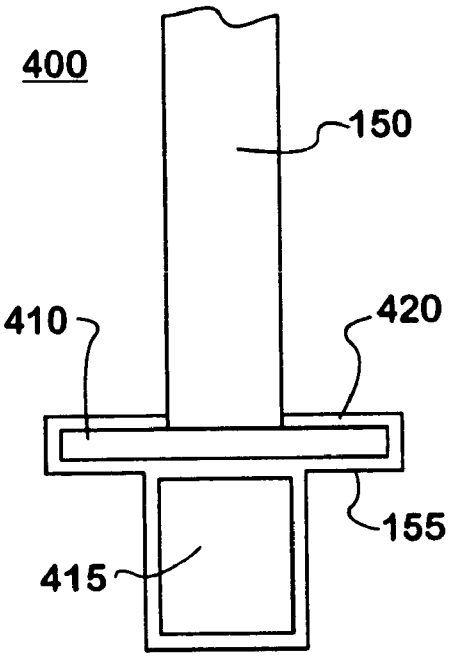
FIG. 4 shows a cross-sectional side view of an extension assembly for a cartridge thermostat when the engine is cold according to the present invention.

FIG. 4 shows an extension assembly 400 of the cartridge thermostat 130 according to the present invention. Extension assembly 400 includes a diaphragm 410 operatively positioned adjacent to a wax plug 415 inside an extension housing 420. The shaft 150 is connected to the diaphragm 410. The extension assembly 400 is sealed. As shown, the extension assembly 400 may be integrated with and configured to form the plug 155. Alternatively, the extension assembly 400 may be positioned along the shaft 150 in any position as long as it senses the temperature of the coolant. In these alternated configurations, the shaft may incorporate a spring or other elastomeric device to avoid the effect of too much extension against the engine by-pass 165.

Figure 5:
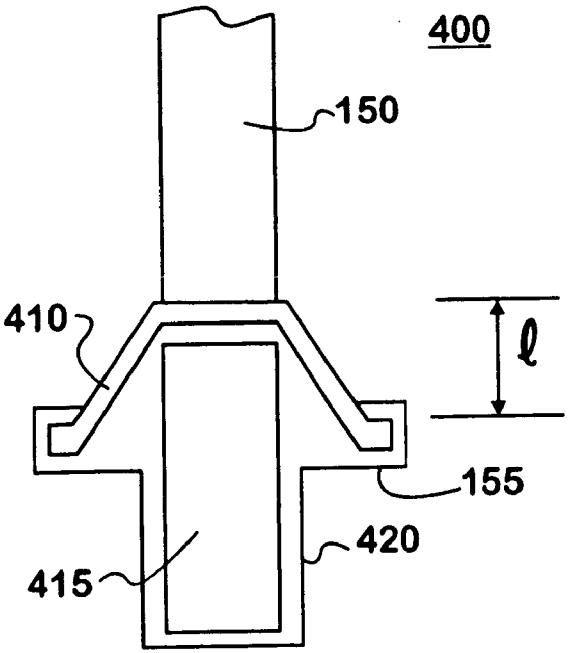
FIG. 5 shows a cross-sectional side view of an extension assembly for a cartridge thermostat when the engine is hot according to the present invention.

As the coolant temperature increases, the wax plug 415 expands as shown in FIG. 5. The expansion of the wax plug 415 moves the plug 155 the distance of Rs stroke length, l, which is on the order of 0.5 in. The plug 155 closes the engine by-pass 165, thus stopping the flow of coolant to the engine by-pass 165. Since the plug 155 no longer blocks the pilot 115, coolant flows freely into the radiator passage 170. Once the plug 155 stops against the engine by-pass 165, the wax plug 415 will expand along the center portion of the expansion assembly 400 to avoid over flexing the shaft 150.

Figure 6:
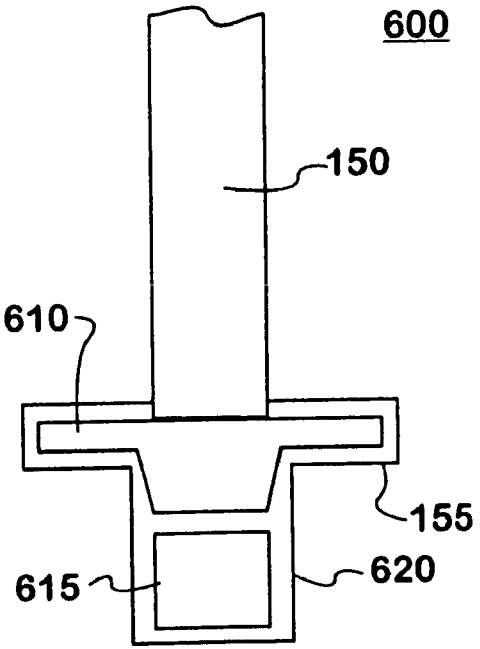
FIG. 6 shows a cross-sectional side view of an extension assembly for a cartridge thermostat using an alternate diaphragm design according to the present invention.

FIG. 6 shows an alternative extension assembly 600 of the cartridge thermostat 130 according to the present invention. The extension assembly 600 includes a diaphragm 610 operatively positioned adjacent to a wax plug 615 inside an extension housing 620. The diaphragm 610 has a thicker middle section as shown. The shaft 150 is connected to the diaphragm 610, adjacent to the thicker middle section. The extension assembly 600 is sealed and is configured to form the plug 155.

When the coolant temperature rises, the wax plug 615 expands against the diaphragm 610 moving the plug 155 against the engine by-pass 165. The thicker middle section of the diaphragm 610 increases the stroke length when the wax plug 615 expands.

Figure 7:
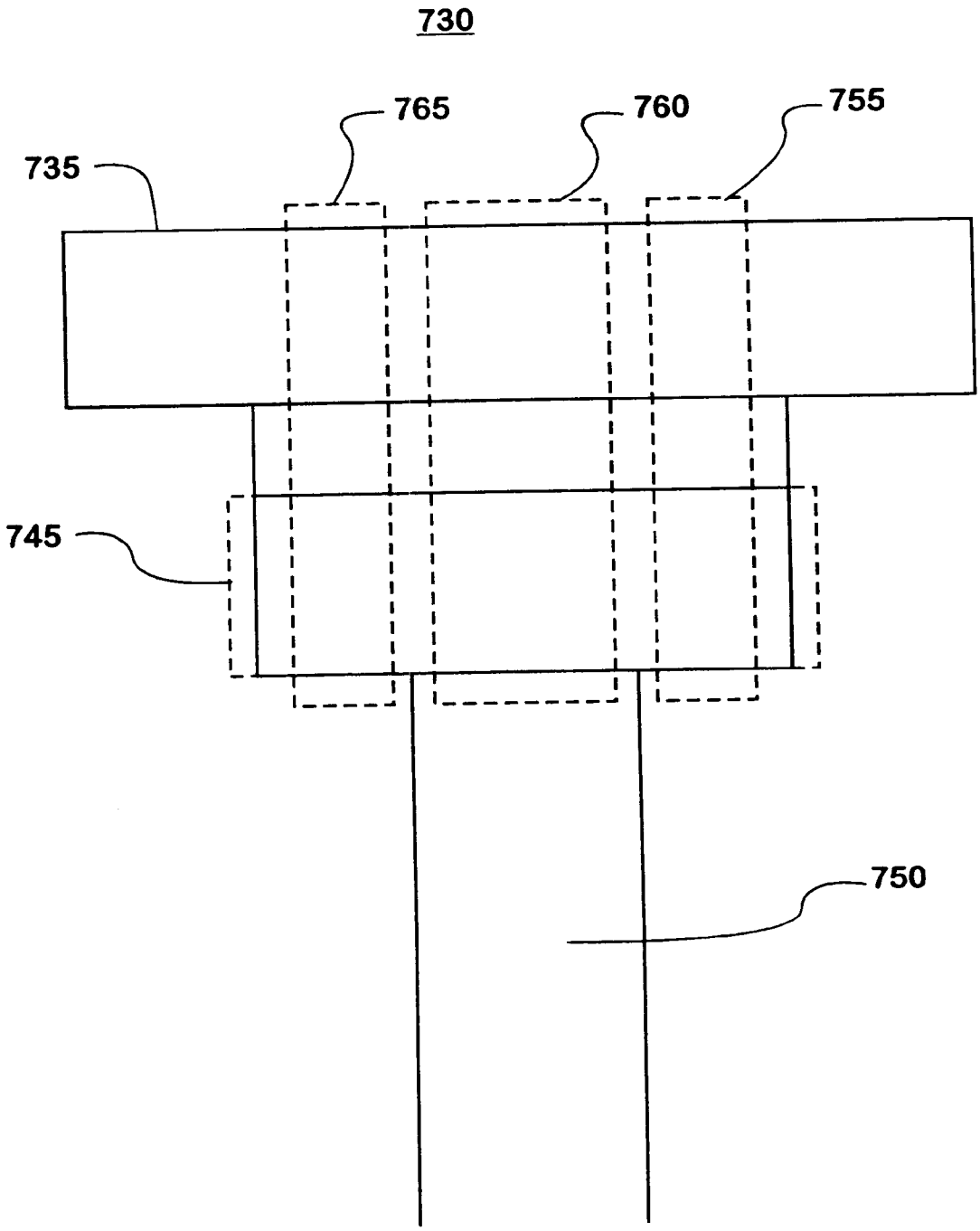
FIG. 7 shows a cross-sectional side view of a cartridge thermostat having an electronic thermostat according to the present invention.

FIG. 7 shows the upper portion of an electronic cartridge thermostat 730 according to the present invention. The cartridge thermostat 130-may be an electronic thermostat 730 even though the extension assembly 400 is described using a wax plug 415, 615. The electronic thermostat 730 may be any commercially available thermostat configured for the cartridge thermostat system including an electronically-controlled value or similar mechanism. The lower portion is not shown and would include the electronically-controlled valve or similar device. With the electronic thermostat 730, the shaft 150 connects to an electronically-controlled plug 155 (not shown) or other control valve.

The electronic cartridge thermostat 730 has a cap 735 and a threaded portion 745. Terminals and wiring passages 755, 765 extend through the cap 735, and the threaded portion 1145. The terminals and wire passages 755, 765 permit wires for to pass through the cap 735 to the electronically-controlled valve or similar device.

An optional air bleed mechanism 760 also extends through the cap 735 and the threaded portion 745. The air bleed mechanism allows any air "trapped" in the coolant system to escape. The air bleed mechanism 760 replaces or works with an air bleed mechanism on the coolant manifold (not shown). The air bleed mechanism 760 may be used in the cartridge thermostats 130 using a wax plug.

Figure 8:
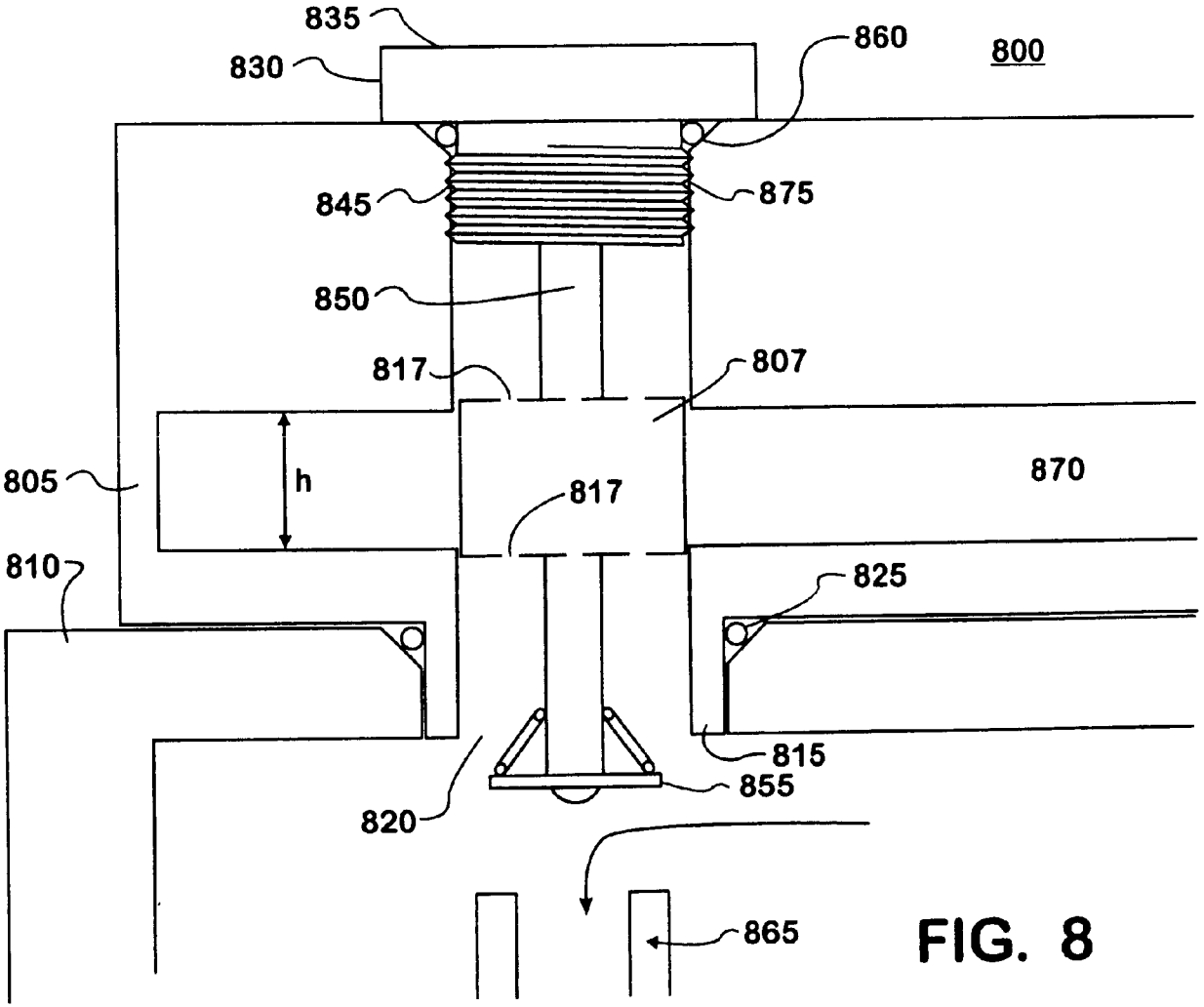
FIG. 8 shows a cross-sectional side view of a cartridge thermostat system when the engine is cold according to the second embodiment of the present invention.

FIG. 8 shows a second embodiment of a cartridge thermostat system 800 according to the present invention. Similar to the first embodiment, a coolant manifold 805 is mounted on a cylinder head 810 of an engine (not shown). The coolant manifold 805 forms a radiator passageway 870 for circulating coolant through the radiator (not shown). The radiator passageway has an inside diameter or height, h.

The cylinder head 810 has an engine by-pass 865 for circulating coolant through the engine. The coolant manifold 805 also has a pilot 815, which inserts into a coolant port 820 formed by the cylinder head 810. A manifold o-ring 825 extends around the pilot 815 at its interface with the coolant port 820 for sealing the coolant manifold 805 to the cylinder head 810.

A cartridge thermostat 830 extends through a thermostat port 875 formed by the coolant manifold 805. The cartridge thermostat 830 has a cap 835, a shaft 850, a plug 855, and a sleeve 807. A wax plug is hidden from view inside the cartridge thermostat 830. The wax plug expands and contracts upon heating and cooling to actuate the plug 855. A thermostat o-ring 860 surrounds the threaded portion 845 adjacent to the cap 835.

The sleeve 807 is configured to have outside dimensions substantially the same as the inside dimensions of the pilot 815. The sleeve 807 also has larger height than h, the height or inside diameter of the radiator passageway 870. As shown, both the sleeve 807 and the pilot 815 have a cylindrical shape. Other shapes may be used. The sleeve 807 has sleeve holes 815 for coolant to flow through the inside of the sleeve 807.

The sleeve 807 is mounted on the cartridge thermostat 830 to move along the shaft 850 as the plug 855 moves. The mounting may be done using a co-axial tube (not shown), coaxial to the shaft 850 and connecting the sleeve 807 to the plug 855. Alternatively, supporting rods (not shown) may be used to connected and position the sleeve 807 above the plug 855. Other mounting methods may be used.

To install the cartridge thermostat 830, it is aligned and screwed into place. The thermostat o-ring 860 engages the coolant manifold 805 thus sealing the thermostat port 875. The shaft 850 extends through the coolant manifold 805 and into the pilot 815. The shaft 850 places the plug 855 in an operating position adjacent to the engine by-pass 865. The shaft 850 also positions the sleeve 807 in an operating position adjacent to the radiator passage 870. The plug 855 and shaft 850 may include a spring (not shown) or other elastomeric device to compensate for their expansion when the coolant is hot. To remove the cartridge thermostat 830, it is simply unscrewed from the coolant manifold 105.

The sleeve 807 is designed to operate in conjunction with the radiator passage 870 once the cartridge thermostat 830 is installed. The sleeve 807 is slightly larger than h, the height or inside diameter of the radiator passage 870, thus preventing coolant from flowing into the radiator passage 870 when the sleeve 807 blocks the radiator passage 870.

When the engine is cold, the sleeve 807 blocks the radiator passage 870 as shown in FIG. 8. The position of the sleeve 807 prevents coolant from flowing though the radiator passage 870 to the radiator. The engine by-pass 865 is open, permitting coolant to circulate through the engine.

Figure 9:
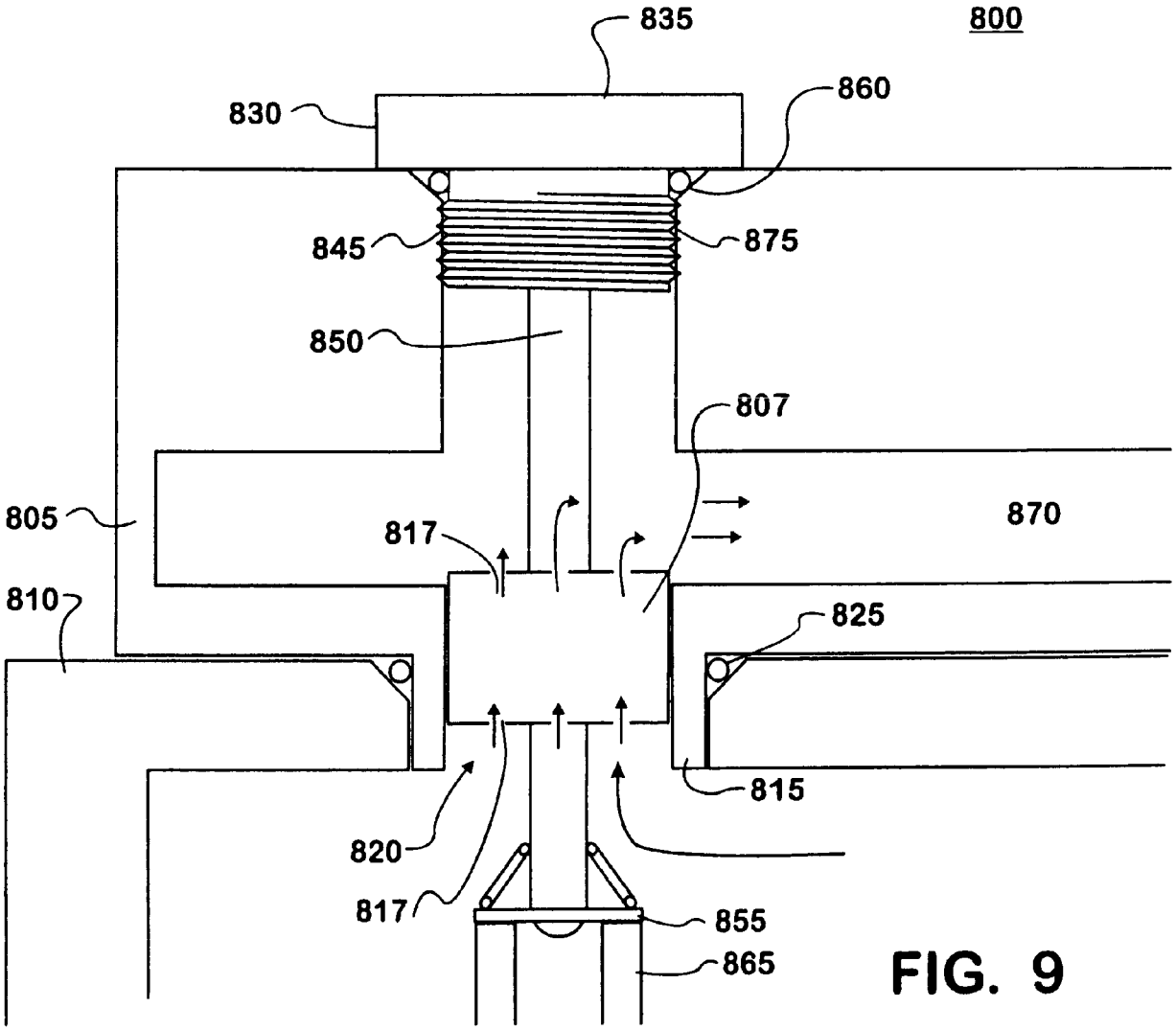
FIG. 9 shows a cross-sectional side view of a cartridge thermostat system when the engine is hot according to the second embodiment of the present invention.

As the engine temperature increases, the coolant temperature also rises. The wax plug expands inside the cartridge thermostat 830. At a certain temperature or predetermined value, usually 190° F., the wax plug moves the plug 855 against the opening for the engine by-pass 865. The movement of the plug 855 also moves the sleeve 807 to open the radiator passage 870 as shown in FIG. 9. As a result, the coolant stops flowing through the engine by-pass 865. The coolant flows through the sleeve holes 815 and into the radiator passage 870, and then into the radiator.

Figure 10:
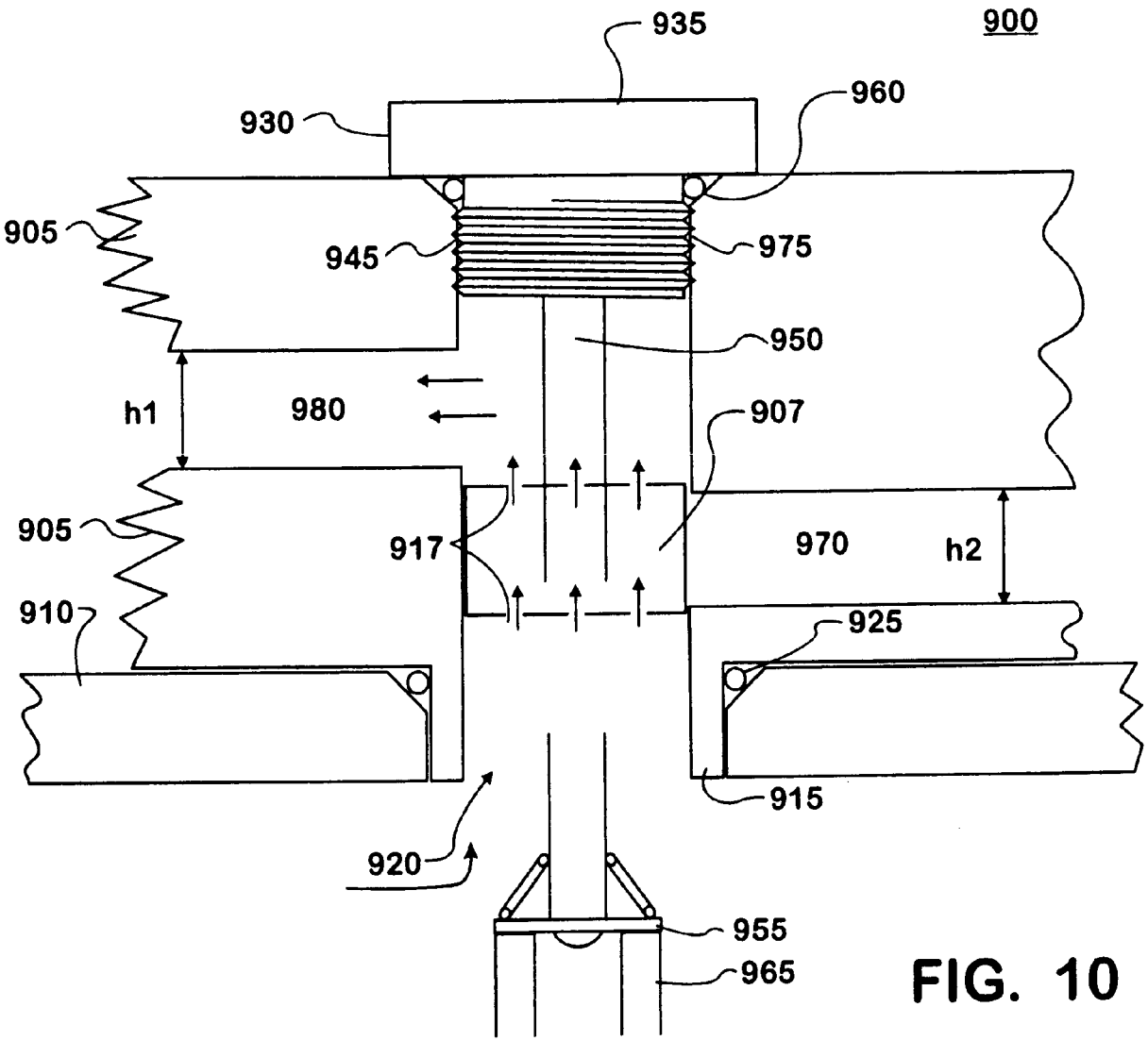
FIG. 10 shows a cross-sectional side view of a cartridge thermostat system when the engine is cold according to the third embodiment of the present invention.

FIG. 10 shows a third embodiment of a cartridge thermostat system 900 according to the present invention. Similar to the first embodiment, a coolant manifold 905 is mounted on a cylinder head 910 of an engine (not shown). The coolant manifold 905 forms a manifold by-pass 980 and a radiator passageway 970 for circulating coolant through the radiator (not shown). The manifold by-pass 980 has an inside diameter or height, H1. The radiator passage 970 has and inside diameter or height, H2. H1 and H2 may be the same height or different heights. The cylinder head 910 has an engine by-pass 965. The coolant manifold 905 also has a pilot 915, which inserts into a coolant port 920 formed by the cylinder head 910. A manifold o-ring 925 extends around the pilot 915 at its interface with the coolant port 920 for sealing the coolant manifold 905 to the cylinder head 910.

A cartridge thermostat 930 extends through a thermostat port 975 formed by the coolant manifold 905. The cartridge thermostat 930 has a cap 935, a threaded portion 945, a shaft 950, a plug 955, and a sleeve 907. A wax plug is hidden from view inside the cartridge thermostat 930. The wax plug expands and contracts upon heating and cooling to actuate the sleeve 907. The threaded portion 945 is configured to engage a similarly threaded portion of the coolant manifold 905 along the thermostat port 975. A thermostat o-ring 960 surrounds the cartridge thermostat 930 adjacent to the cap 935.

The sleeve 907 is configured to have outside dimensions substantially the same as the inside dimensions of the pilot 915. As shown, both the sleeve 907 and the pilot 915 have a cylindrical shape. Other shapes may be used. The sleeve 907 slides along the shaft 950. The sleeve 907 has sleeve holes 915 for coolant to flow through the sleeve 907. The height of the sleeve 907 is larger than either H1 or H2.

To install the cartridge thermostat 930, it is aligned and screwed into place. The thermostat o-ring 960 engages the coolant manifold 905 thus sealing the thermostat port 975. The shaft 950 extends through the coolant manifold 905 and into the pilot 915. The shaft 950 is of such a length to place the plug 955 against the engine by-pass 965, thus preventing coolant from flowing through it. The plug 955 and shaft 950 may have a spring (not shown) or other elastomeric device to compensate for their expansion when the coolant is hot. To remove the cartridge thermostat 930, it is simply unscrewed from the coolant manifold 905.

The sleeve 907 is designed to operate in conjunction with the manifold by-pass 980 and the radiator passage 970 once the cartridge thermostat 930 is installed. The sleeve 907 has a slightly larger surface area than the manifold by-pass 980 and the radiator passage 970. The sleeve 907 prevents coolant from flowing into the manifold by-pass 980 when the sleeve 907 blocks the manifold by-pass 980. The sleeve 907 prevents coolant from flowing into the radiator passage 970 when the sleeve 907 blocks the radiator passage 970.

When the engine is cold, the sleeve 907 blocks the radiator passage 970 as shown in FIG. 10. The position of the sleeve 907 prevents coolant from flowing though the radiator passage 970 to the radiator. The coolant flows through the sleeve holes 915 into the manifold by-pass 980.

Figure 11:
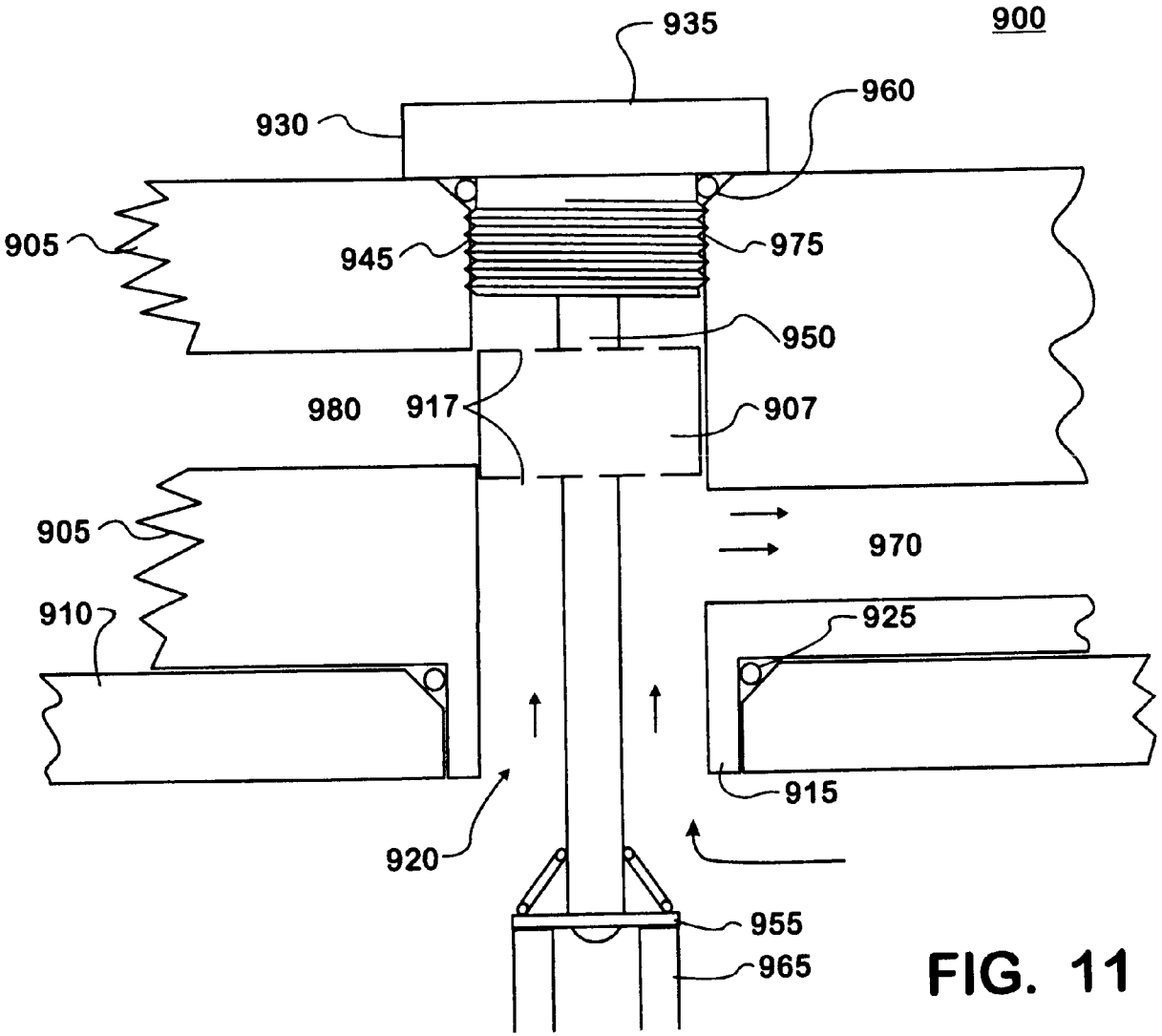
FIG. 11 shows a cross-sectional side view of a cartridge thermostat system when the engine is hot according to the third embodiment of the present invention.

As the engine temperature increases, the coolant temperature also rises. The wax plug expands inside the cartridge thermostat 930. At a certain temperature or predetermined value, usually 190° Fahrenheit, the wax plug moves the sleeve 907 to open the radiator passage 970 and to close the manifold by-pass 970 as shown in FIG. 11. The coolant cannot flow through the manifold by-pass 980. The coolant flows through into the radiator passage 970 into the radiator.

Figure 12:
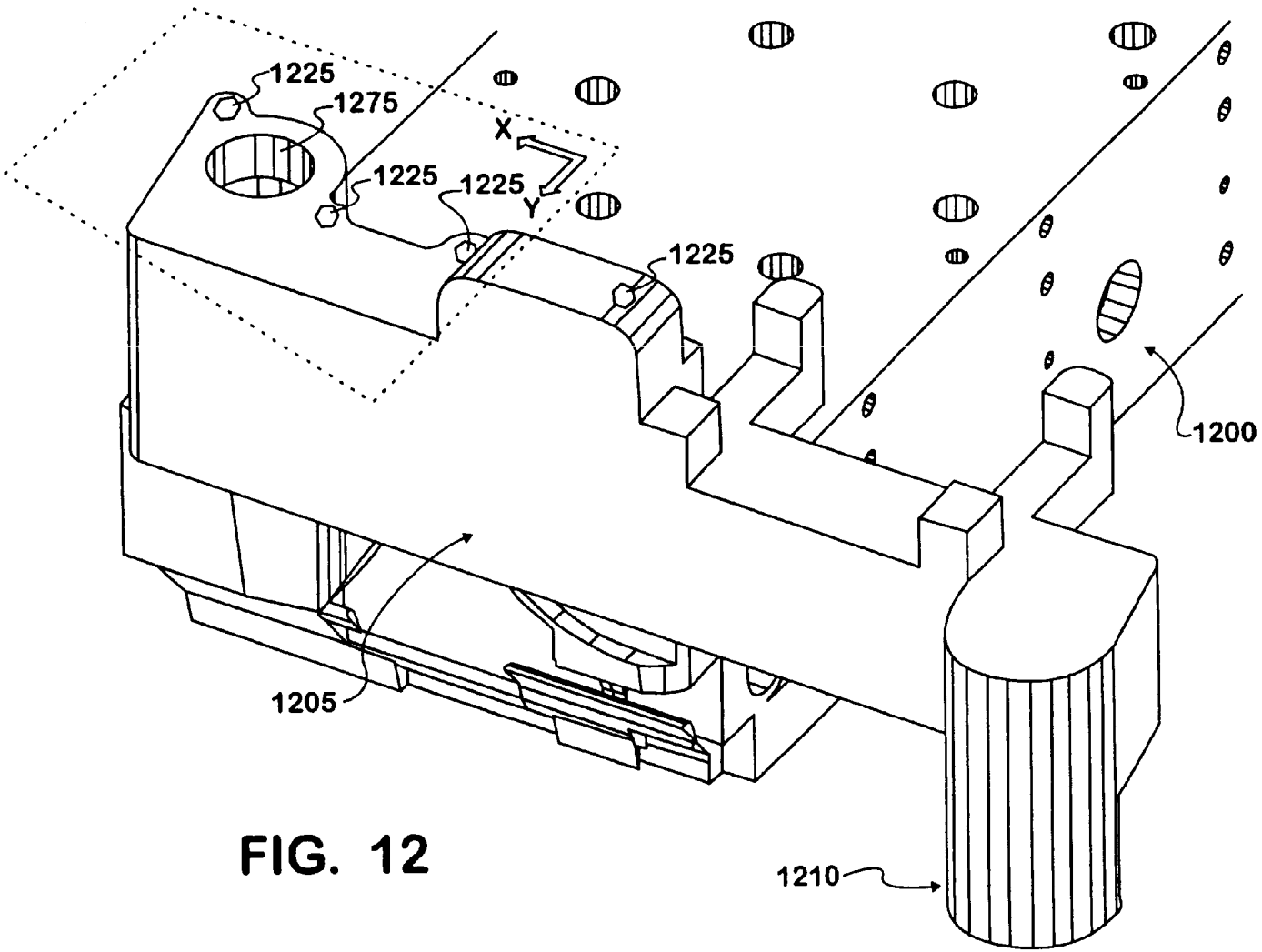
FIG. 12 shows an external perspective view of a coolant manifold for the cartridge thermostat system of the present invention.
Figure 13:
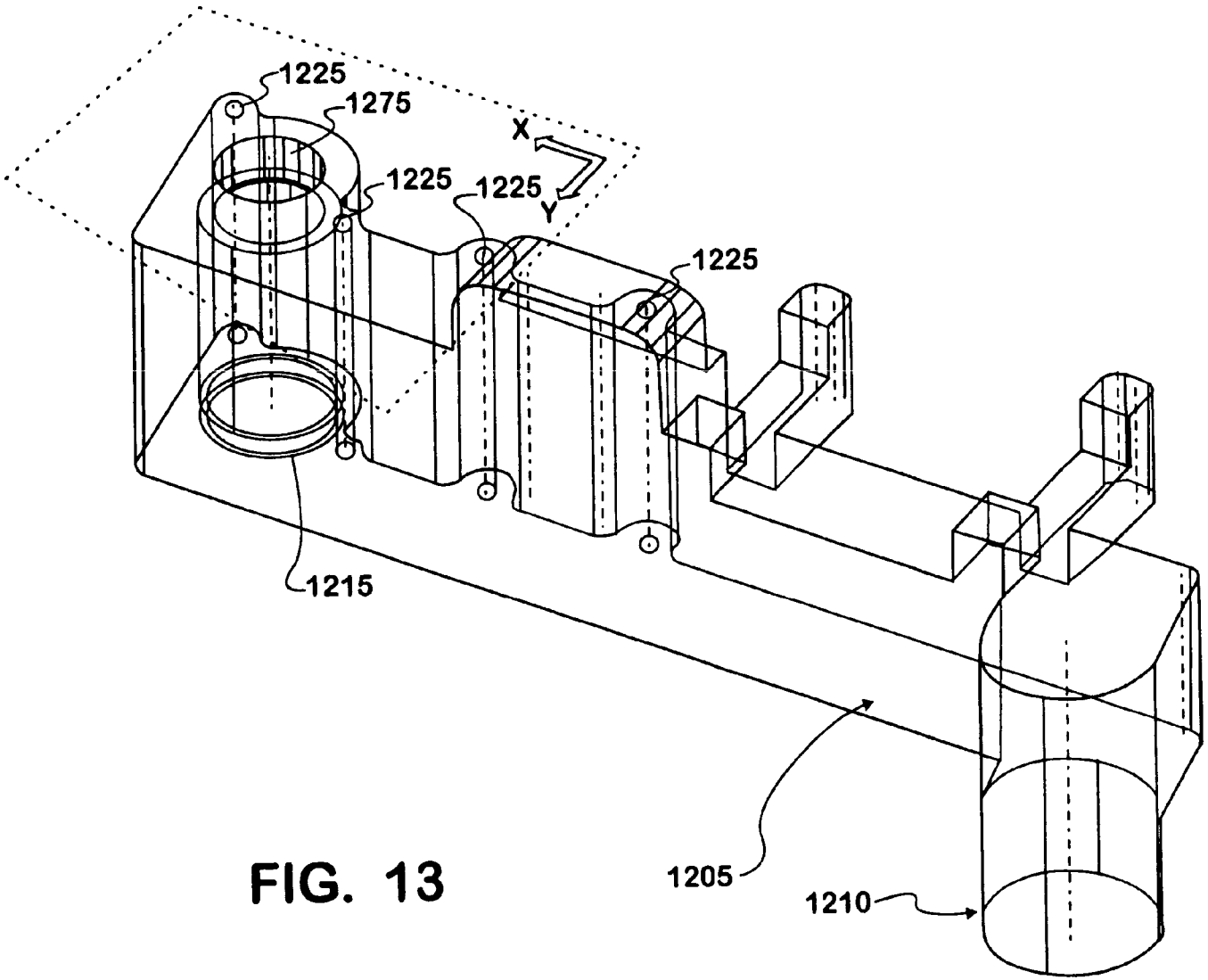
FIG. 13 shows an internal perspective view of a coolant manifold for the cartridge thermostat system of the present invention.

FIGS. 12–13 show exterior and interior views respectively of a coolant manifold 1205 for the present invention. The coolant manifold 1205 is mounted on a cylinder head 1200 of an engine (not shown) using mounting bolts 1225. The coolant manifold 1205 is an iron or steel casting, but may be made from another material and using another fabrication method. The coolant manifold 1205 has a pilot 1215 for interfacing with the cylinder head 1200 and forms a thermostat port 1275, which is threaded for receiving the threaded portion of a cartridge thermostat (not shown). The coolant manifold 1205 has a snout 1210 for connecting a radiator hose (not shown).

FIGS. 14–17 show a fourth embodiment of a cartridge thermostat system 1400, 1600 according to the present invention. The fourth embodiment uses the same coolant manifold 1405 for different engine configurations.

Figure 14:
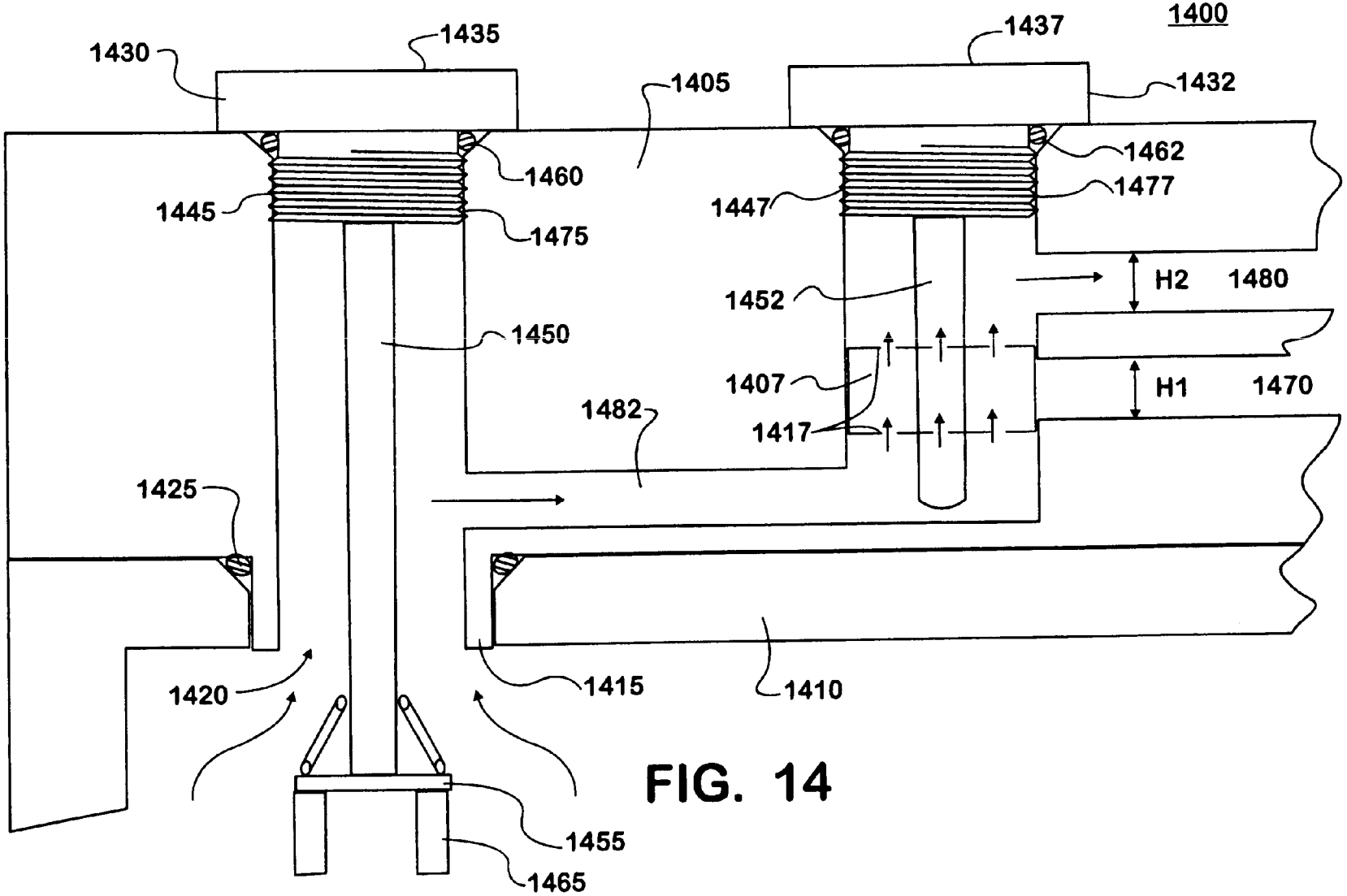
FIG. 14 shows a cross-sectional side view of a cartridge thermostat system when a first engine configuration is cold according to the fourth embodiment of the present invention.
Figure 15:
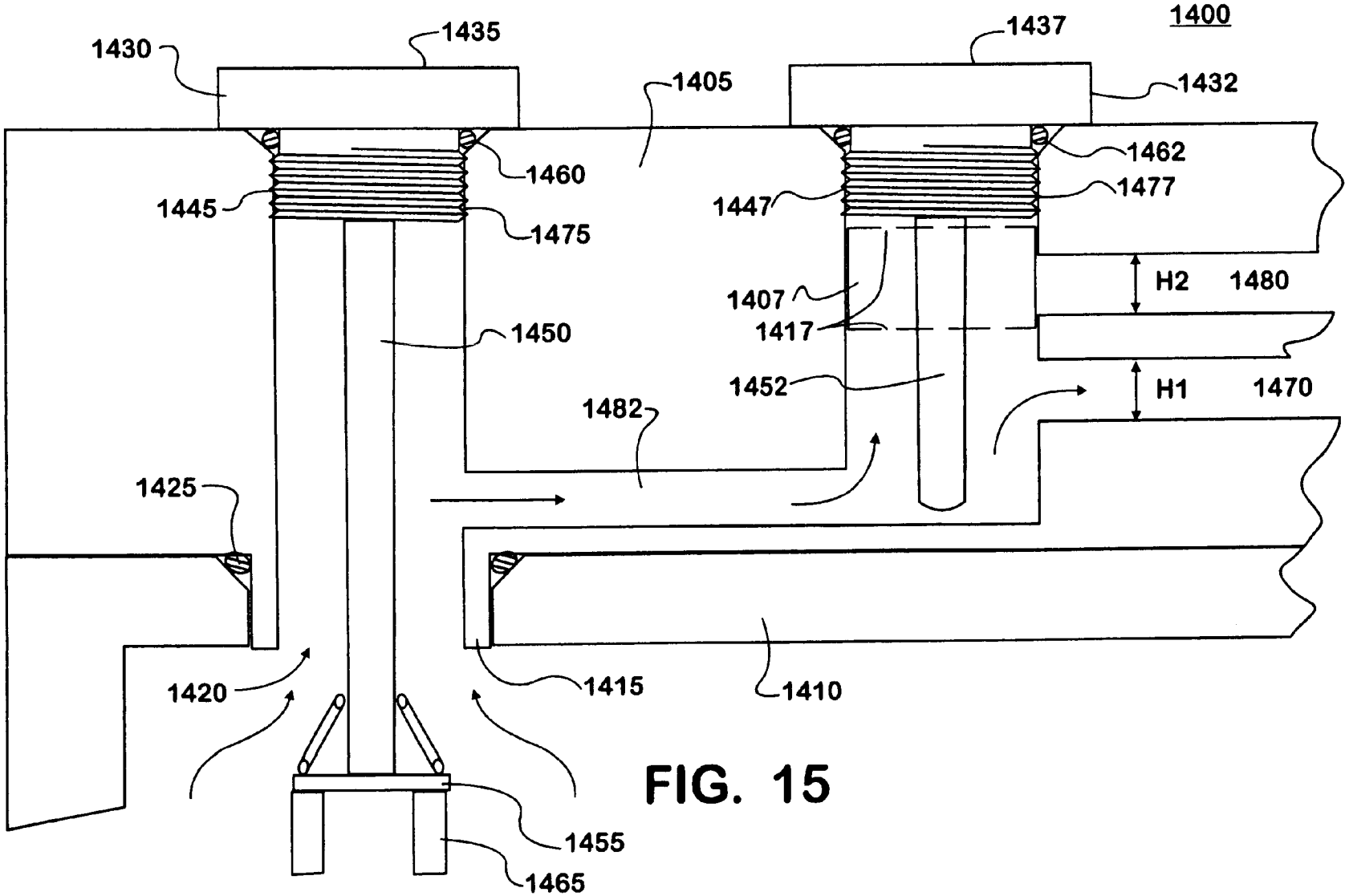
FIG. 15 shows a cross-sectional side view of a cartridge thermostat system when a first engine configuration is hot according to the fourth embodiment of the present invention.

FIGS. 14–15 show a cartridge thermostat system 1400 for a first engine configuration. The coolant manifold 1405 is mounted on a cylinder head 1410 of the first engine (not shown). The cylinder head 1410 has an engine by-pass 1465. The cylinder head 1410 forms a coolant port 1420 for receiving a pilot 1415 of the coolant manifold 1405. A manifold o-ring 1425 extends around the pilot 1415 at its interface with the coolant port 1420 for sealing the coolant manifold 1405 to the cylinder head 1410.

The coolant manifold 1405 forms a first thermostat port 1475 interconnected by a coolant passage 1482 to a second thermostat port 1477. The coolant manifold 1405 forms a radiator passage 1470 and a manifold by-pass 1480, both connected independently to the second thermostat port 1477. The radiator passage 1470 circulates coolant to the radiator (not shown). The radiator passage 1470 has an inside diameter or height, H1. The manifold by-pass 1480 circulates coolant to the engine (not shown). The manifold by-pass 1480 has an inside diameter or height, H2, H1 and H2 may be the same or different. While the coolant passage 1482, the radiator passage 1470, and the manifold by-pass 1480 are shown in the same plane, they may be radially disposed around the second thermostat port 1477.

For the first engine configuration, a cartridge plug 1430 extends through the first thermostat port 1475. The cartridge plug 1430 has a cap 1435, a threaded portion 1445, a shaft 1450, and a plug 1455. A thermostat o-ring 1460 surrounds the threaded portion 1445 adjacent to the cap 1435.

To install the cartridge plug 1430, it is aligned and screwed into place. The thermostat o-ring 1460 engages the coolant manifold 1405 thus sealing the first thermostat port 1475. The shaft 1450 extends through the coolant manifold 1405 and the pilot 1415. The shaft 1450 places the plug 1455 against the engine by-pass 1465, thus blocking coolant from flowing through the engine by-pass 1465. The plug 1455 and shaft 1450 may include a spring (not shown) or other elastomeric device to compensate for their expansion when the coolant is hot. To remove the cartridge plug 1430, it is simply unscrewed from the coolant manifold 1405.

Additionally, a cartridge thermostat 1432 extends through the second thermostat port 1477. The cartridge thermostat 1432 has a cap 1437, a threaded portion 1477, a shaft 1452, and a sleeve 1407. A wax plug is hidden from view inside the cartridge thermostat 1432. The wax plug expands and contracts upon heating and cooling to actuate the sleeve 1407. A thermostat o-ring 1462 surrounds the threaded portion 1447 adjacent to the cap 1435.

The sleeve 1407 is configured to have substantially the same outside dimensions as the inside dimensions of the second thermostat port 1477. The sleeve 1407 also has larger height than either H1, the height of the radiator passageway 1470, or H2, the height of the manifold by-pass 1480. As shown, both the sleeve 1407 and the second thermostat port 1477 have a cylindrical shape. Other shapes may be used. The sleeve 1407 has sleeve holes 1417 for coolant to flow through the inside of the sleeve 1407.

The sleeve 1407 is mounted on the cartridge thermostat 1432 to move along the shaft 1450. The mounting may be done using a co-axial tube (not shown). Alternatively, supporting rods (not shown) may be used to connect and position the sleeve 1407. Other mounting methods may be used. Regardless of the mounting method, the sleeve 1407 is operatively connected to the hidden wax plug in the cartridge thermostat 1432. The wax plug causes the sleeve 1407 to move along the shaft 1450.

To install the cartridge thermostat 1432, it is aligned and screwed into place. The thermostat o-ring 1462 engages the coolant manifold 1405 thus sealing the second thermostat port 1477. The shaft 1450 extends through the coolant manifold 1405 and positions the sleeve 1407 in an operating position adjacent to the radiator passage 1470 and the manifold by-pass 1480. The shaft 1450 may have a spring (not shown) or other elastomeric device to compensate for its expansion when the coolant is hot. To remove the cartridge thermostat 1432, it is simply unscrewed from the coolant manifold 1405.

The sleeve 1407 is designed to operate in conjunction with the radiator passage 1470 and the manifold by-pass 1480 once the cartridge thermostat 1432 is installed. The sleeve 1407 is slightly larger than the radiator passage 1470 and the manifold by-pass 1480. When the engine is cold, the sleeve 1407 blocks the radiator passage 1470 as shown in FIG. 14. The position of the sleeve 1407 prevents coolant from flowing though the radiator passage 1470 to the radiator (not shown). The coolant flows through the sleeve holes 1417 into the manifold by-pass 1480 for circulation through the engine.

As the engine temperature increases, the coolant temperature also rises. The wax plug expands inside the cartridge thermostat 1432. At a certain temperature or predetermined value, usually 190° F., the wax plug moves the sleeve 1407 to open the radiator passage 1470 and close the manifold by-pass 1480 as shown in FIG. 15. As a result, the coolant stops flowing through the sleeve holes 1417 and the manifold by-pass 1480. The coolant flows through the radiator passage 1470, and then into the radiator.

Figure 16:
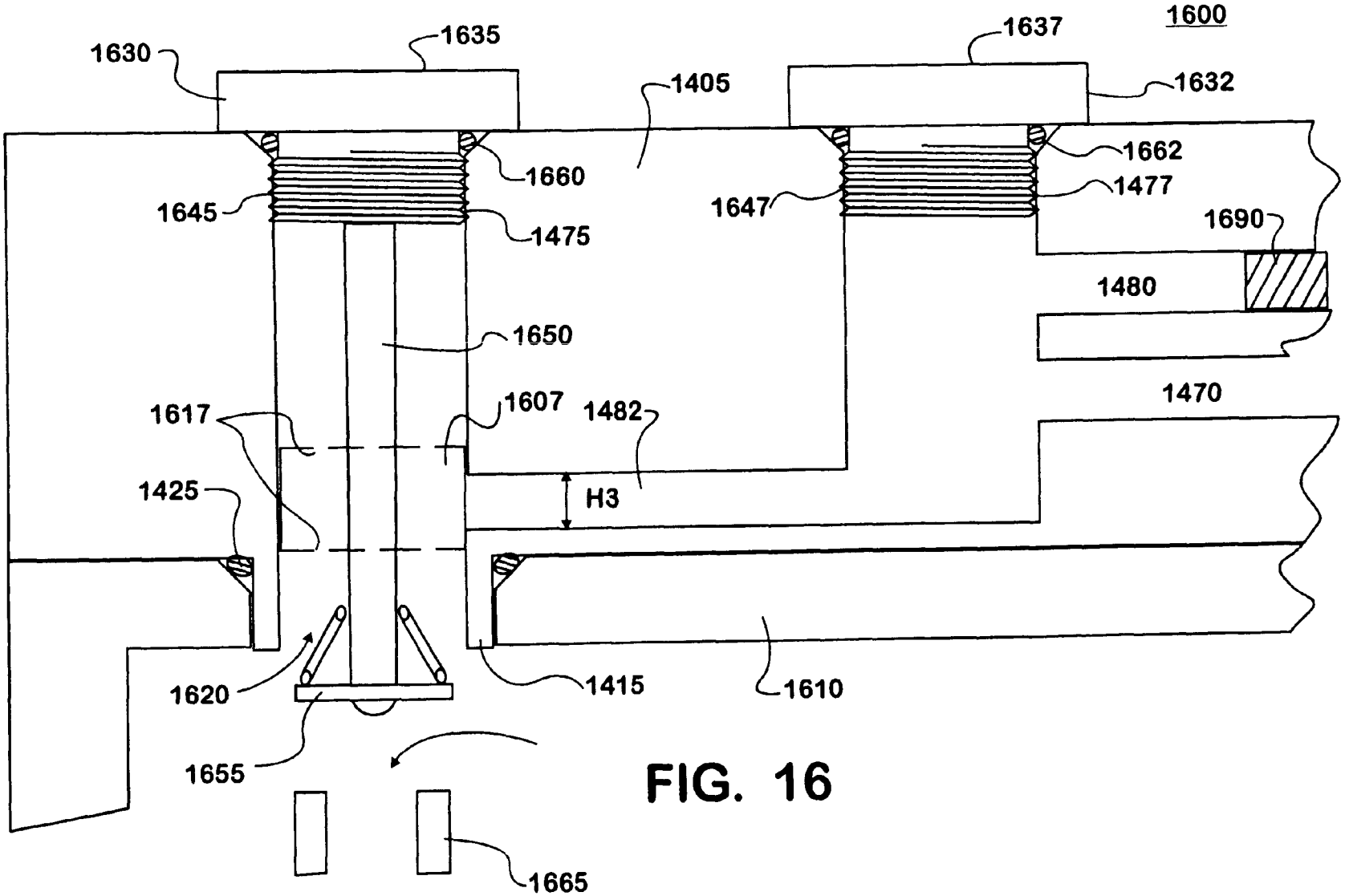
FIG. 16 shows a cross-sectional side view of a cartridge thermostat system when a second engine configuration is cold according to the fourth embodiment of the present invention.
Figure 17:
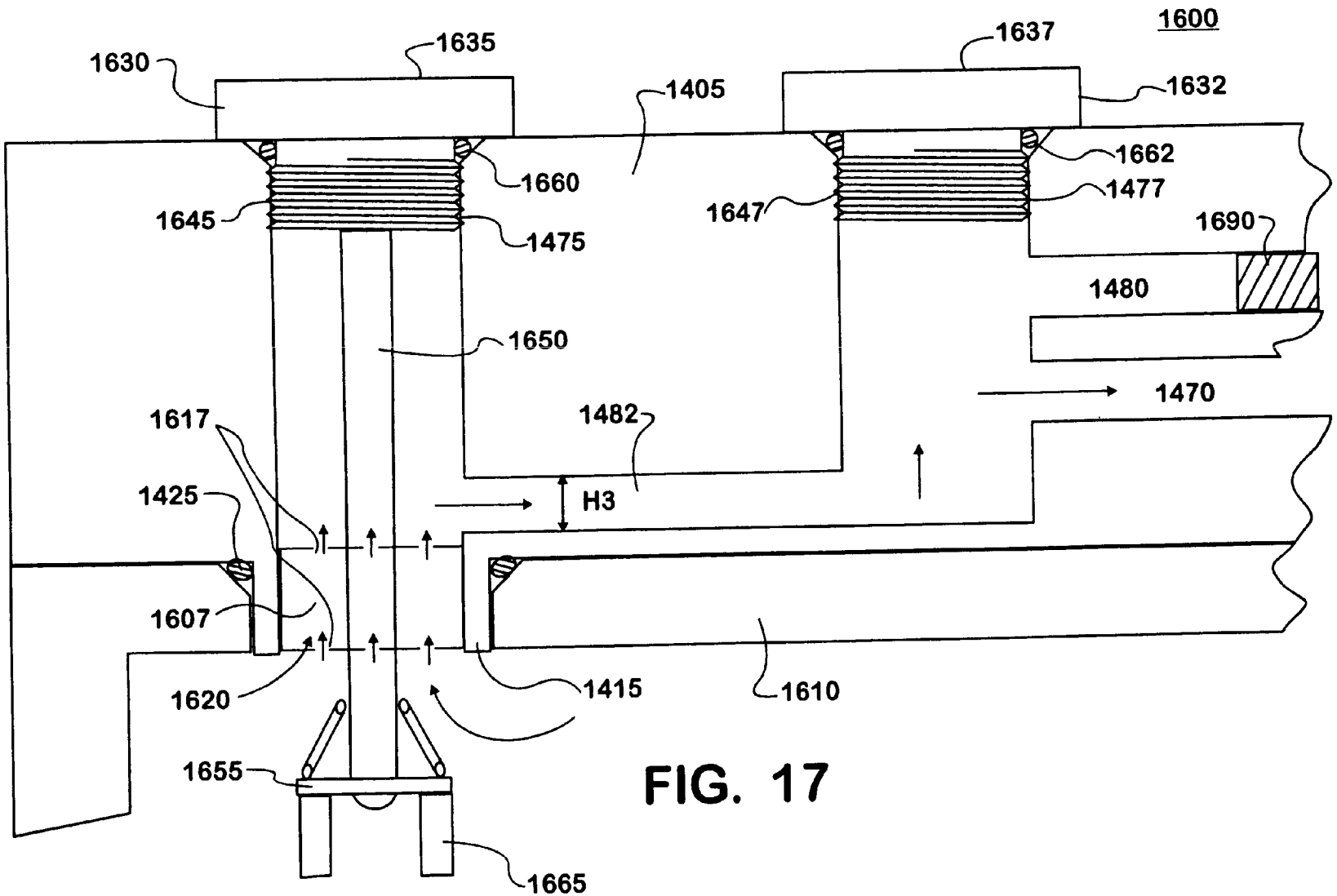
FIG. 17 shows a cross-sectional side view of a cartridge thermostat system when a second engine configuration is hot according to the fourth embodiment of the present invention.

FIGS. 16–17 show a cartridge thermostat system 1600 for a second engine configuration. The coolant manifold 1405 is mounted on a cylinder head 1610 of the second engine (not shown). The cylinder head 1610 has an engine by-pass 1665. The cylinder head 1610 forms a coolant port 1620 for receiving a pilot 1415 of the coolant manifold 1405. A manifold o-ring 1425 extends around the pilot 1415 at its interface with the coolant port 1620 for sealing the coolant manifold 1405 to the cylinder head 1610.

The coolant manifold 1405 forms a first thermostat port 1475 interconnected by a coolant passage 1482 to a second thermostat port 1477. Coolant passage 1482 has an inside diameter or height, H3. The coolant manifold 1405 also forms a radiator passage 1470 and a manifold by-pass 1480, both connected independently to the second thermostat port 1477. The radiator passage 1470 circulates coolant to the radiator (not shown). The radiator passage 1470 and coolant passage 1482 may have the same or different inside diameters or heights. While coolant passage 1482, radiator passage 1470, and manifold by-pass 1480 are shown in the same plane, they may be radially disposed around the second thermostat port 1477.

For the second engine configuration, a manifold plug 1690 stops the flow of coolant through the manifold by-pass 1480. The manifold plug 1690 may be any variety of plugging device suitable to stop the flow of coolant. The manifold plug 1690 may be a cap design having a threaded portion for screwing onto the coolant manifold 1405 to close the exit of the manifold by-pass 1480.

A cartridge cap 1632 extends into the second thermostat port 1477. The cartridge cap 1632 has a cap 1637 and a threaded portion 1647. A thermostat o-ring 1662 surrounds the threaded portion 1647 adjacent to the cap 1637. To install the cartridge cap 1632, it is aligned and screwed into place. The thermostat o-ring 1662 engages the coolant manifold 1405 thus sealing the second thermostat port 1477. To remove the cartridge cap 1632, it is simply unscrewed from the coolant manifold 1405.

A cartridge thermostat 1630 extends through the first thermostat port 1475. The cartridge thermostat 1630 has a cap 1635, a threaded portion 1645, a shaft 1650, a sleeve 1607, and a plug 1655. A thermostat o-ring 1660 surrounds the threaded portion 1645 adjacent to the cap 1635. A wax plug is hidden from view inside the cartridge thermostat 1630. The wax plug expands and contracts upon heating and cooling to actuate the plug 1655.

To install the cartridge thermostat 1630, it is aligned and screwed into place. The thermostat o-ring 1660 engages the coolant manifold 1405 thus sealing the first thermostat port 1475. The shaft 1650 extends through the coolant manifold 1405 and the pilot 1415, placing the plug 1655 in an operating position adjacent to the engine by-pass 1665. The plug 1655 and shaft 1650 may include a spring (not shown) or other elastomeric device to compensate for their expansion when the coolant is hot. To remove the cartridge thermostat 1630, it is simply unscrewed from the coolant manifold 1405.

The sleeve 1607 is configured to have substantially the same outside dimensions as the inside dimensions of the first thermostat port 1475. The sleeve 1607 also has a larger height than H3, the height or inside diameter of the coolant passage 1482. As shown, both the sleeve 1607 and the first thermostat port 1475 have a cylindrical shape. Other shapes may be used. The sleeve 1607 has sleeve holes 1617 for coolant to flow through the inside of the sleeve 1607.

The sleeve 1607 is mounted on the cartridge thermostat 1630 to move along the shaft 1650 as the plug 1655 moves. The mounting may be done using a co-axial tube (not shown) that is coaxial to the shaft 1652. Alternatively, supporting rods (not shown) may be used to connect the sleeve 1607 to the plug 1655. Other mounting methods may be used. Regardless of the mounting method, the sleeve 1607 is operatively connected to move as the plug 1655 moves in relation to the hidden wax plug.

The sleeve 1607 is designed to operate in conjunction with the coolant passage 1482 once the cartridge thermostat 1430 is installed. The sleeve 1607 is slightly larger than the coolant passage 1482. When the engine is cold, the sleeve 1407 blocks the coolant passage 1482 as shown in FIG. 16. The plug 1655 does not engage the engine by-pass 1665. The position of the sleeve 1407 prevents coolant from flowing though the coolant passage 1482. The position of the plug 1655 permits coolant to flow through the engine by-pass 1665 for circulation through the engine.

As the engine temperature increases, the coolant temperature also rises. The wax plug expands inside the cartridge thermostat 1630 At a certain temperature or predetermined value, usually 190° F., the wax plug moves the sleeve 1607 to open the radiator passage 1470 as shown in FIG. 17. The wax plug also moves the plug 1655 to close the engine by-pass 1665. As a result, the coolant stops flowing through the engine by-pass 1665. The coolant flows through the sleeve holes 1417, into the coolant passage 1482, through the second thermostat port 1477, and then through the radiator passage 1470 into the radiator.

Figure 18:
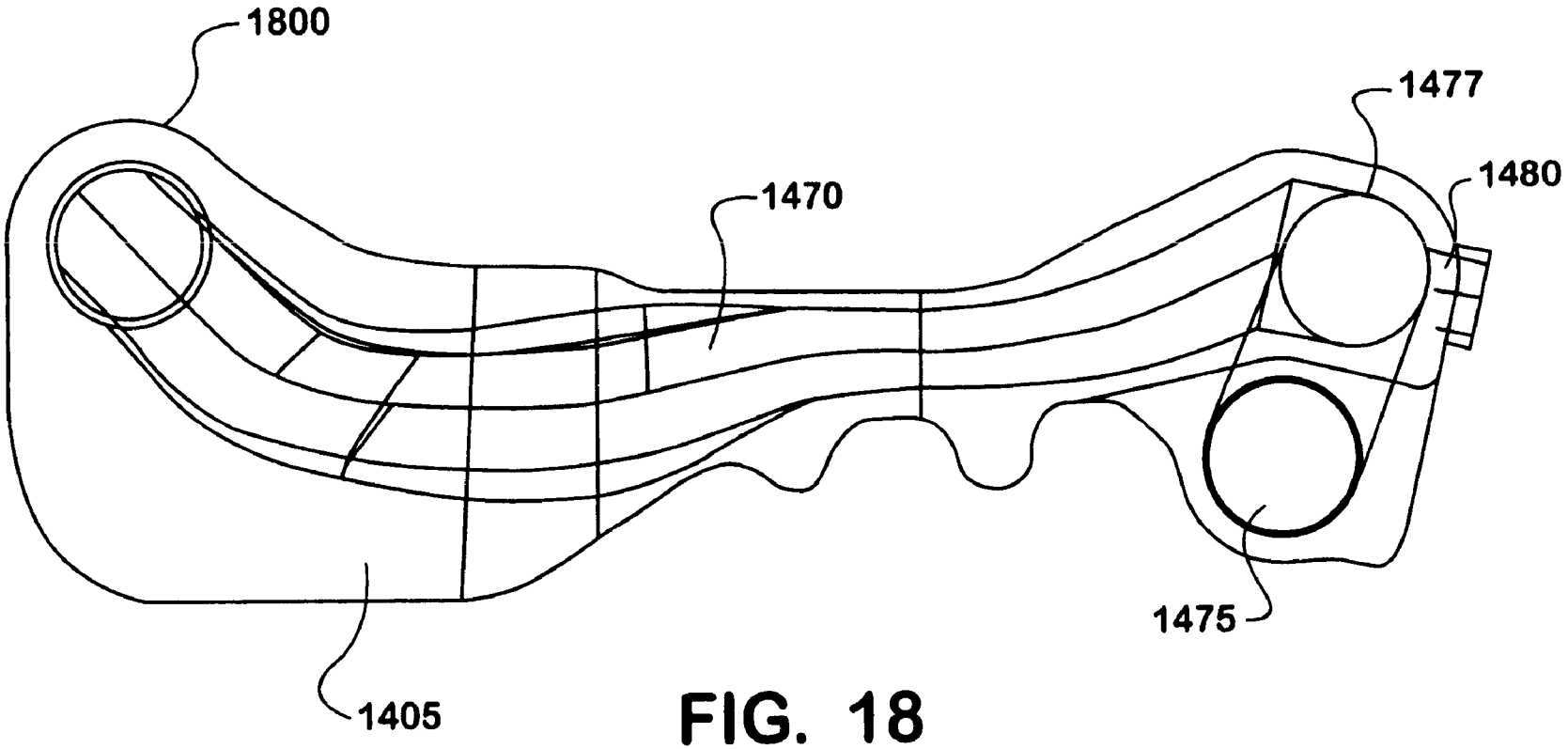
FIG. 18 shows a top perspective view of a coolant manifold for the cartridge thermostat system according to the fourth embodiment of the present invention.
Figure 19:
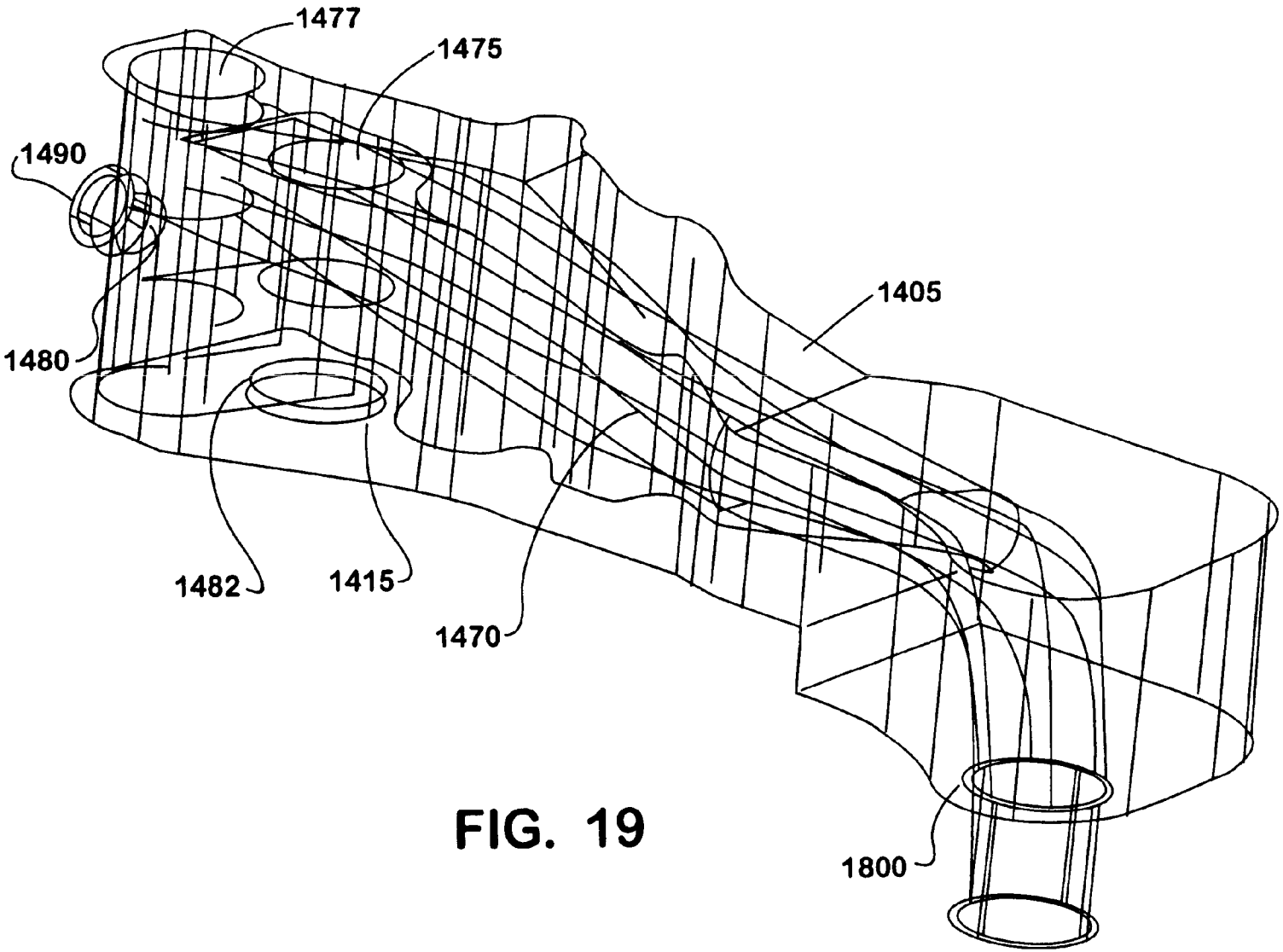
FIG. 19 shows a side perspective view of a coolant manifold for the cartridge thermostat system according to the fourth embodiment of the present invention.
Figure 20:
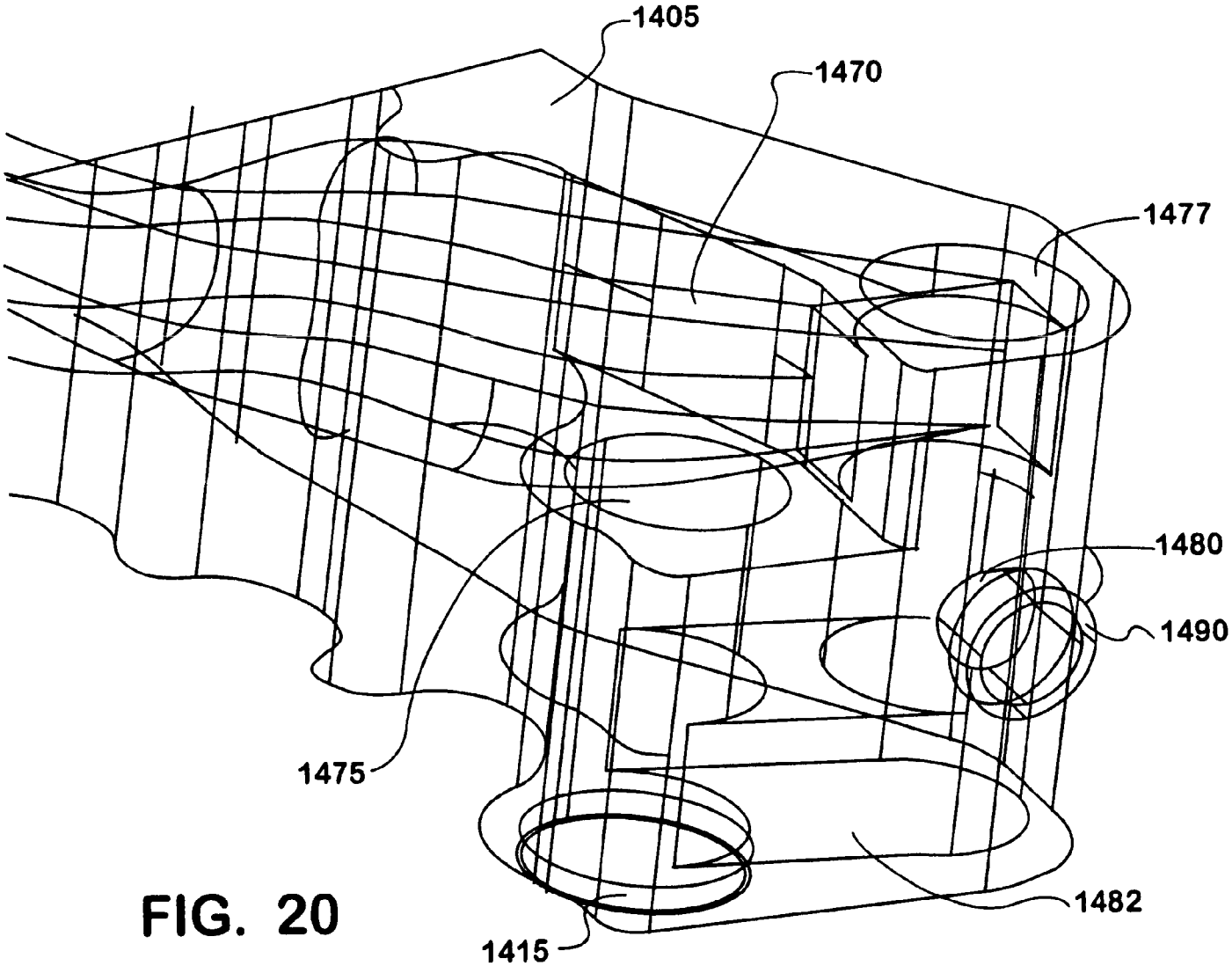
FIG. 20 shows a front perspective view of a coolant manifold for the cartridge thermostat system according to the fourth embodiment of the present invention.

FIGS. 18–20 show various views of the coolant manifold 1405 according to the fourth embodiment of the present invention. FIG. 18 is a top view of the coolant manifold 1405 showing the first thermostat port 1475, the second thermostat port 1477, the manifold by-pass 1480, the radiator passage 1470, and the snout 1800 for connecting to a radiator hose (not shown).

FIG. 19 is a side view of the coolant manifold 1405 showing the pilot 1415, the first thermostat port 1475, the second thermostat port 1477, the manifold by-pass 1480, the radiator passage 1470, the coolant passage 1482, and the snout 1800 for connecting to a radiator hose (not shown). The manifold by-pass 1480 has a plug extension 1490 for receiving the manifold plug 1690 (not shown). The first thermostat port 1475 has a different height than the second thermostat port 1477.

FIG. 20 is a front view of the coolant manifold 1405 showing the pilot 1415, the first thermostat port 1475, the second thermostat port 1477, the manifold by-pass 1480, the plug extension 1490, the radiator passage 1470, and the coolant passage 1482. This view also shows the difference in height between the first thermostat port 1475 and the second thermostat port 1477.

While the invention has been described and illustrated, this description is by way of example only. Additional advantages will occur readily to those skilled in the art, who may make changes without departing from the true spirit and scope of the invention. Therefore, the invention is not limited to the specific details, representative devices, and illustrated examples in this description.

We claim:

1. A cartridge thermostat system for use in an internal combustion engine, the cartridge thermostat system comprising:

a cylinder head comprising an engine by-pass, the cylinder head further comprising a coolant port;

a coolant manifold operatively attached to the cylinder head, the coolant manifold comprising a radiator passage, a pilot cooperatively attached to the coolant port to thereby form a connection between the coolant manifold and cylinder head, and a thermostat port able to accept the cartridge thermostat; and a cartridge thermostat mounted in the coolant manifold to operatively position a plug adjacent to an engine by-pass and a sleeve to block a radiator passage whereby the plug is positioned against the engine by-pass and the sleeve is simultaneously positioned adjacent to the radiator passage by the cartridge thermostat when coolant temperature reaches a predetermined value.

2. The cartridge thermostat system of claim 1, wherein the cartridge thermostat comprises:

a cap;

a fastening portion for securing the cartridge thermostat to the thermostat port;

a shaft extending toward the engine by-pass and having the plug and sleeve appropriately attached thereon; and a wax plug cooperatively attached to the shaft;

whereby the wax plug expands when coolant temperature reaches a predetermined value thereby actuating the shaft to position the plug against the engine by-pass and simultaneously the sleeve adjacent to the radiator passage.

3. The cartridge thermostat system of claim 2, wherein the fastening portion and the thermostat port are threadedly connected.

4. The cartridge thermostat system of claim 2, further comprising a manifold O-ring extending around the pilot at the connection with the coolant port.

5. The cartridge thermostat system of claim 2, wherein the predetermined value is 190 degrees Fahrenheit.

6. A cartridge thermostat system for use in an internal combustion engine, the cartridge thermostat system comprising:

a cylinder head comprising an engine by-pass and a coolant port;

a coolant manifold comprising, a pilot cooperatively attached to the coolant port to thereby form a sealed connection between the coolant manifold and cylinder head, a thermostat port, and a radiator passage;

a cartridge thermostat cooperatively mounted in the thermostat port, the cartridge thermostat comprising a cap;

a fastening portion for securing the cartridge thermostat to the thermostat port;

a shaft extending toward the engine by-pass and having a plug and sleeve appropriately attached thereon; and a wax plug cooperatively attached to the shaft;

whereby the wax plug expands when coolant temperature reaches a predetermined value thereby actuating the shaft to position the plug against the engine by-pass and the sleeve adjacent to the radiator passage allowing complete coolant flow via sleeve holes to the radiator passage.

7. A cartridge thermostat system for use in an internal combustion engine, the cartridge thermostat system comprising:

a coolant manifold operatively attached to a cylinder head, the cylinder head comprising a coolant port, and the coolant manifold comprising a manifold by-pass, a radiator passage, a pilot cooperatively attached to the coolant port to thereby form a connection between the coolant manifold and cylinder head, and a thermostat port able to accept a cartridge thermostat; and a cartridge thermostat having a sleeve mounted in the coolant manifold and disposed to operatively position the sleeve to block the radiator passage and be openly adjacent the manifold by-pass when coolant temperature is less than a predetermined value and where the cartridge thermostat operatively positions the sleeve to block the manifold by-pass and be openly adjacent the radiator passage when the coolant temperature exceeds the predetermined value.

8. The cartridge thermostat system of claim 7, wherein the cartridge thermostat comprises:

a cap;

a fastening portion for securing the cartridge thermostat to the thermostat port;

a shaft operatively supporting a plug and sleeve thereon; and a wax plug operatively attached to the shaft;

whereby the wax plug expands when coolant temperature reaches a predetermined value thereby simultaneously actuating the shaft to position the sleeve to block the manifold by-pass and adjacent to the radiator passage when the coolant temperature exceeds the predetermined value.

9. The cartridge thermostat system of claim 8, wherein the plug is secured against an engine by-pass.

10. The cartridge thermostat system of claim 9, wherein the fastening portion and the thermostat port are threadedly connected.

11. The cartridge thermostat system of claim 9, further comprising a manifold O-ring extending around the pilot at the connection with the coolant port.

12. The cartridge thermostat system of claim 8, wherein the predetermined value is 190 degrees Fahrenheit.

13. A cartridge thermostat system for use in an internal combustion engine, the cartridge thermostat system comprising:

a cylinder head comprising a coolant port;

a coolant manifold comprising, a pilot cooperatively attached to the coolant port to thereby form a sealed connection between the coolant manifold and cylinder head, a thermostat port a manifold by-pass, and a radiator passage;

a cartridge thermostat operatively mounted in the thermostat port, the cartridge thermostat comprising a cap;

a fastening portion for securing the cartridge thermostat to the thermostat port;

a shaft supporting a plug and sleeve thereon; and a wax plug operatively attached to the shaft;

whereby the cartridge thermostat operatively positions the sleeve to block the radiator passage and adjacent to the manifold by-pass when coolant temperature is less than a predetermined value and where the wax plug expands thereby actuating the shaft to position the sleeve to block the manifold by-pass and adjacent to the radiator passage when the coolant temperature exceeds the predetermined value.

14. The cartridge thermostat system of claim 13, wherein the plug is secured against an engine by-pass.

15. The cartridge thermostat system of claim 13, wherein the fastening portion and the thermostat port are threadedly connected.

16. The cartridge thermostat system of claim 13, further comprising a manifold O-ring extending around the pilot at the connection with the coolant port.

17. The cartridge thermostat system of claim 13, wherein the predetermined value is 190 degrees Fahrenheit.

18. A cartridge thermostat system for use in an internal combustion engine, the cartridge thermostat system comprising:

a coolant manifold operatively attached to a cylinder head, the coolant manifold comprising a first thermostat port, a second thermostat port connected the first thermostat port via a coolant passage, a manifold by-pass adjacent to the second thermostat, and a radiator passage adjacent to the second thermostat;

a first cartridge thermostat mounted in the coolant manifold to operatively position a plug against an engine by-pass; and a second cartridge thermostat mounted in the coolant manifold to operatively position a sleeve to block the radiator passage and adjacent to the manifold by-pass when coolant temperature is less than predetermined value and where the cartridge thermostat operatively positions the sleeve to block the manifold by-pass and to be adjacent to the radiator passage when the coolant temperature exceeds the predetermined value.

19. The cartridge thermostat system of claim 18, wherein the cylinder head comprises a coolant port; and where the coolant manifold comprises a pilot cooperatively attached to the coolant port to thereby form a connection between the coolant manifold and cylinder head, a first thermostat port able to accept the first cartridge thermostat, and a second thermostat port able to accept the second cartridge thermostat.

20. The cartridge thermostat system of claim 19, wherein the first cartridge thermostat comprises:

a first cap;

a first fastening portion for securing the first cartridge thermostat to the first thermostat port;

a first shaft operatively supporting a plug thereon.

21. The cartridge thermostat system of claim 20, wherein the second cartridge thermostat comprises:

a second cap;

a second fastening portion for securing the second cartridge thermostat to the second thermostat port;

a second shaft operatively supporting a sleeve thereon; and a wax plug operatively attached to the second shaft;

whereby the wax plug expands when coolant temperature reaches a predetermined value thereby simultaneously actuating the second shaft to position the sleeve to block the manifold by-pass and adjacent to the radiator passage when the coolant temperature exceeds the predetermined value.

22. The cartridge thermostat system of claim 20, wherein the plug is secured against an engine by-pass.

23. The cartridge thermostat system of claim 21, wherein the first fastening portion and the first thermostat port are threadedly connected.

24. The cartridge thermostat system of claim 21, wherein the second fastening portion and the second thermostat port are threadedly connected.

25. The cartridge thermostat system of claim 21, further comprising a manifold O-ring extending around the pilot at the connection with the coolant port.

26. The cartridge thermostat system of claim 21, wherein the predetermined value is 190 degrees Fahrenheit.

27. A cartridge thermostat system for use in an internal combustion engine, the cartridge thermostat system comprising:

a cylinder head comprising an engine by-pass;

a coolant manifold operatively attached to a cylinder head, the coolant manifold comprising a first thermostat port, a second thermostat port connected the first thermostat port via a coolant passage, a radiator passage adjacent to the second thermostat;

a first cartridge thermostat mounted in the coolant manifold to operatively position a plug against an engine by-pass; and a first and second cartridge thermostat mounted in the coolant manifold;

whereby the first cartridge thermostat operatively positions the plug against the engine by-pass and the sleeve adjacent to the coolant passage when coolant temperature is less than predetermined value and where the first cartridge thermostat operatively positions the sleeve to block the manifold by-pass and to be adjacent to the coolant passage when the coolant temperature exceeds the predetermined value.

28. The cartridge thermostat system of claim 27, wherein the cylinder head further comprises a coolant port; and where the coolant manifold comprises a pilot cooperatively attached to the coolant port to thereby form a connection between the coolant manifold and cylinder head, a first thermostat port able to accept the first cartridge thermostat, and a second thermostat port able to accept the second cartridge thermostat.

29. The cartridge thermostat system of claim 28, wherein the first cartridge thermostat comprises:

a first cap;

a first fastening portion for securing the first cartridge thermostat to the first thermostat port;

a first shaft operatively supporting a plug and a sleeve thereon;

a wax plug operatively attached to the first shaft;

whereby the wax plug expands when coolant temperature reaches a predetermined value thereby actuating the first shaft to position the plug against the engine by-pass and the sleeve adjacent to coolant passage when the coolant temperature exceeds the predetermined value.

30. The cartridge thermostat system of claim 29, wherein the second cartridge thermostat comprises:

a second cap;

a second fastening portion for securing the second cartridge thermostat to the second thermostat port.

31. The cartridge thermostat system of claim 30, wherein the coolant manifold further comprises manifold by-pass blocked by a manifold plug.

32. The cartridge thermostat system of claim 30, wherein the first fastening portion and the first thermostat port are threadedly connected.

33. The cartridge thermostat system of claim 32, wherein the second fastening portion and the second thermostat port are threadedly connected.

34. The cartridge thermostat system of claim 28, further comprising a manifold O-ring extending around the pilot at the connection with the coolant port.

35. The cartridge thermostat system of claim 28, wherein the predetermined value is 190 degrees Fahrenheit.

* * * * *